US007470176B2

(12) United States Patent
Morris et al.

(10) Patent No.: US 7,470,176 B2
(45) Date of Patent: Dec. 30, 2008

(54) CONVERTING EXISTING PRIOR ART FUME HOODS INTO HIGH PERFORMANCE LOW AIRFLOW STABLE VORTEX FUME HOODS

(75) Inventors: Robert Harris Morris, Wharton, NJ (US); Steven Anthony Morris, San Francisco, CA (US)

(73) Assignee: Flow Safe Inc, Denville, NJ (US)

( * ) Notice: Subject to any disclaimer, the term of this patent is extended or adjusted under 35 U.S.C. 154(b) by 0 days.

(21) Appl. No.: 11/546,964

(22) Filed: Oct. 12, 2006

(65) Prior Publication Data

US 2007/0087677 A1 Apr. 19, 2007

Related U.S. Application Data

(60) Provisional application No. 60/726,561, filed on Oct. 14, 2005.

(51) Int. Cl.
*F24F 7/00* (2006.01)

(52) U.S. Cl. ..... 454/61

(58) Field of Classification Search ..... 454/187, 454/339; 285/183
See application file for complete search history.

(56) References Cited

U.S. PATENT DOCUMENTS

| | | | | |
|---|---|---|---|---|
| 3,000,292 | A | | 9/1961 | Wojan |
| 3,025,780 | A | | 3/1962 | Russell |
| 3,111,077 | A | | 11/1963 | Cortright |
| 3,218,953 | A | | 11/1965 | Grow et al. |
| 3,254,588 | A | | 6/1966 | Truhan |
| 4,177,717 | A | | 12/1979 | Grow et al. |
| 4,280,400 | A | | 7/1981 | Longworth |
| 4,434,711 | A | | 3/1984 | Zboralski et al. |
| 4,436,022 | A | | 3/1984 | Zboralski et al. |
| 4,528,898 | A | * | 7/1985 | Sharp et al. ..... 454/61 |
| 4,706,553 | A | * | 11/1987 | Sharp et al. ..... 454/61 |
| 4,741,257 | A | | 5/1988 | Wiggin et al. |
| 4,773,311 | A | | 9/1988 | Sharp |
| 4,785,722 | A | | 11/1988 | Dollhopf et al. |
| 4,893,551 | A | | 1/1990 | Sharpe et al. |
| 4,959,990 | A | | 10/1990 | Morris |

(Continued)

OTHER PUBLICATIONS

1999 American Society of Heating Refrigeration and Air-Conditioning Engineers (ASHRAE) Engineering Handbook on Laboratories, Fig. 1, p. 13.3

(Continued)

*Primary Examiner*—Steven B Mcallister
*Assistant Examiner*—Samantha A Miller
(74) *Attorney, Agent, or Firm*—Mathews, Shepherd, McKay & Bruneau

(57) ABSTRACT

The present invention provides a method and conversion kits, that include all necessary components, to convert any style existing prior art fume hood into a stable vortex high performance low airflow fume hood that can accommodate varying size prior art fume hoods without altering the fume hood envelope or customizing the conversion kit. The articulating rear baffle can be lifted out for cleaning debris that collects in baffle conduit. The conversion can be accomplished without drilling mounting holes into an asbestos liner and can be applied on any size or style prior art fume hood. The present invention also provides a new fume hood incorporating the features of the method and kit.

35 Claims, 26 Drawing Sheets

U.S. PATENT DOCUMENTS

| | | | | |
|---|---|---|---|---|
| 5,117,746 | A * | 6/1992 | Sharp | 454/61 |
| 5,240,455 | A | 8/1993 | Sharp | |
| 5,378,195 | A | 1/1995 | Beck | |
| 5,518,446 | A * | 5/1996 | Jacob | 454/61 |
| 5,697,838 | A | 12/1997 | Morris | |
| 5,924,920 | A | 7/1999 | De Luca et al. | |
| 6,080,058 | A | 6/2000 | Coe et al. | |
| 6,089,970 | A * | 7/2000 | Feustel | 454/57 |
| 6,350,194 | B1 * | 2/2002 | Haugen et al. | 454/56 |
| 6,358,137 | B1 * | 3/2002 | Threlfall | 454/61 |
| 6,428,408 | B1 * | 8/2002 | Bell et al. | 454/56 |
| 6,461,233 | B1 | 10/2002 | Gilkison et al. | |
| 6,659,857 | B2 | 12/2003 | Ryan et al. | |
| 6,953,104 | B2 | 10/2005 | Monson et al. | |
| 2003/0109211 | A1 * | 6/2003 | Bastian | 454/56 |

OTHER PUBLICATIONS

2003 American Society of Heathing Refrigeration and Air-Conditioning Engineers (ASHRAE) Engineering Handbook on Laboratories, Fig. 1, p. 14.4.

Scientific Equipment Furniture Association (SEFA) 1-2002 Recommended Practices for Laboratory Fume Hoods, pp. 1-91.

Department of Labor, Occupational Safety and Health Administration (OSHA), Final Rule, 29 CFR Part 1910, vol. 55, No. 21, Jan. 31, 1990 pp. 3300-3335.

Morris et al., Is Your Laboratory Safe? Is Your Fume Hood Safe? , Engineered Systems, vol. 17, No. 1, Jan. 2000, pp. 56-66.

Morris et al., A Question of Design, How can we be sure it is an OSHA-compliant fume hood or a chemical workstation?, pp. 1-10, found at http://www.stevenspublishing.com.

Morris et al., Designing A More Efficient And Safe Fume Hood, paper prepared for "Laboratories for the 21st Century" conference, Sep. 8-10, 1999, pp. 1-25.

* cited by examiner

FUME HOOD LINEAR ROUGHNESS
CORRECTION FACTOR (RCF)

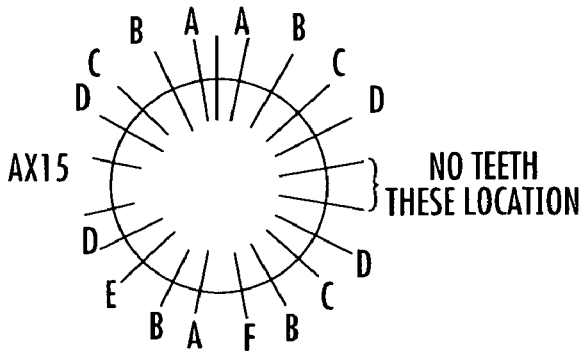
FIG. 23C
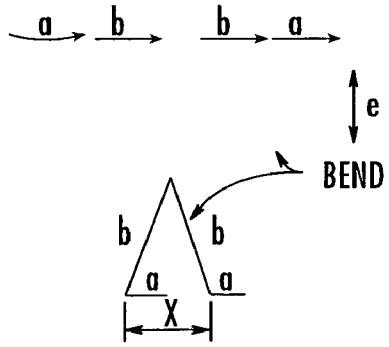
TOOTH FAB DETAIL
MATERIAL & GAUGE SAFE TO DH
FIG. 23D
| DAMPER | A | | | | B | | | | C | | | | D | | | |
|---|---|---|---|---|---|---|---|---|---|---|---|---|---|---|---|---|
| DIA | a | b | e | x | a | b | e | x | a | b | e | x | a | b | e | x |
| 6" | 1/2 | 15/8 | 1/2 | 3/4 | 1/2 | 13/8 | 1/2 | 5/8 | 1/2 | 1 1/8 | 1/2 | 1/2 | 3/8 | 3/8 | 1/2 | 5/8 |
| 8" | 3/4 | 2 | 5/8 | 7/8 | 1/2 | 15/8 | 5/8 | 3/4 | 1/2 | 1 3/8 | 5/8 | 9/16 | 3/8 | 1 | 5/8 | 7/8 |
| 10" | 3/4 | 9 5/8 | 13/16 | 1 1/8 | 3/4 | 2 1/8 | 13/16 | 1 | 1/2 | 1 3/4 | 13/16 | 3/4 | 1/2 | 1 3/8 | 13/16 | 5/8 |
| 12" | 3/4 | 9 5/8 | 15/16 | 1 1/9 | 3/4 | 2 1/2 | 15/16 | 1 1/2 | 3/4 | 2 | 15/16 | 7/8 | 1/2 | 1/2 | 15/16 | 5/8 |
FIG. 23E (ISA STD SYMBOLS)

CONVERTING EXISTING PRIOR ART FUME HOODS INTO HIGH PERFORMANCE LOW AIRFLOW STABLE VORTEX FUME HOODS

CROSS REFERENCE TO RELATED APPLICATION

This application claims the benefit of U.S. Provisional Patent Application No. 60/726,561 filed Oct. 14, 2005, the entirety of which is hereby incorporated by reference into this application.

BACKGROUND OF THE INVENTION

1. Field of the Invention

The present invention relates to fume hood enclosures used for worker protection. More particularly, the present invention relates to a method and apparatus for stabilizing the vortex in both existing and new fume hoods.

2. Description of Related Art

The Occupational Safety and Health Administration (OSHA) defines a fume hood as a four sided exhausted enclosure with a front opening for worker arm penetration. OSHA defines a safe fume hood where worker exposure levels are below the permissible exposure limits (PELs) accepted by government and private occupational health research agencies, including the National Institute of Occupational Safety and Health (NIOSH). OSHA's position is that it is an employer's responsibility to make hood adjustments or replace hoods as necessary when an employer discovers, through routine exposure monitoring and/or employee feedback, that the fume hoods are not effectively reducing employee exposures.

OSHA no longer recommends a given face velocity in feet per minute (fpm) as a reference to worker protection. This is a reversal of OSHA's early 1980's face velocity position when 125 to 150 fpm was recommended for extreme toxic material, 100 to 125 fpm for most materials and 75 to 100 fpm for nuisance materials, dust, and odors. OSHA's earlier position on face velocity and a fume hood's capture protection theory prompted the development of methods to vary exhaust airflow volume of a fume hood in response to varying sash opening positions as a way to maintain a fixed face velocity in fpm.

This type of fume hood, often referred to as a variable air volume (VAV) fume hood, had the potential to save energy associated by reducing the amount of conditioned make-up air exhausted, and therefore reducing the amount of conditioned make-up air wasted. For example, at $0.10 per kilowatt-hour, and depending on hood geographical location, it costs approximately $3.50 to $6.50 a year in the United States to replenish one cubic foot per minute (cfm) of conditioned make-up air exhausted by the fume hood. An average prior art constant air volume six foot fume hood will consume over $300,000 in electrical energy over its expected lifetime. U.S. Pat. No. 4,741,257 pioneered closed-loop variable air volume fume hood control and U.S. Pat. Nos. 4,528,898; 4,705,553; 4,773,311; and 5,240,455 proposed open-loop variable air volume fume hood control. VAV fume hood technology dominated how fume hoods were operated through the 1980's and early 1990's.

Fume hood performance testing prior to OSHA's 1990 Laboratory Worker Regulation was based on smoke visualization and face velocity measurement. Smoke bombs or sticks were placed within the fume hood's enclosure, and as long as the smoke was not seen exiting the fume hood, it was deemed safe to use at the design face velocity. In the early 1990's, a standardized performance tracer gas analysis test began to be used to quantitatively measure fume hood performance in actual spillage rates in parts per million (ppm). The results have a relationship to PELs as determined by NIOSH. The tracer gas testing was developed to address medical studies linking increased birth defects and cancer rates among laboratory workers as highlighted in OSHA's Jan. 31, 1990final rule, 29 CFR Part 1910, on Occupational Exposures to Hazardous Chemicals in Laboratories. The tracer gas test takes into account the influence of a worker in front of the fume hood and analyzer sampling rate set to replicate the average worker breathing.

NIOSH fume hood tracer gas cited published studies indicate variable air volume and constant volume controlled fume hoods did maintain face velocity and may have saved energy but did little to improve worker safety. The tests revealed fume hood designs based on vapor capture face velocity theory failed to work as well, and protect workers from spillage, as manufacturers had suggested.

NIOSH, whose mission is to provide national and world leadership to prevent work-related illness and injury, published a position paper in 2000 stating that fume hood face velocity is not an adequate predictor of fume hood spillage. Additionally, tracer gas fume hood studies indicated between 28% and 38% of the existing stockpile of 1,300,000 to 1,400,000 hoods in the United States fail to meet minimum worker protection, even after attempts to adjust the fume hoods to improve performance. At that time, NIOSH's fume hood failure statistics were based on the American Industrial Hygiene Association's acceptable average fume hood tracer gas spillage rate of 0.1 ppm. In 2003, the acceptable tracer gas spillage rate was reduced by half to a rate 0.05 ppm. As a result, NIOSH's earlier estimates of unsafe fume hoods have nearly doubled.

The fume hood manufacturer's own trade organization, Scientific Equipment Furniture Association (SEFA) went on record in their SEFA 1-2001 "Laboratory Fume Hoods Recommended Practices" indicating, "Face velocity shall be adequate to provide containment. Face velocity is not a measure of safety." This was the first time the fume hood manufactures abandon the face velocity capture theory. The SEFA 1-2000 also stated that the "acceptable 0.05 ppm tracer gas spillage level shall not be implied that this exposure level is safe."

In terms of fume hood design, the problem was further compounded by the fact that prior art fume hoods were designed and specified by architects as furniture, as opposed to being designed, tested and specified by engineers as mechanical equipment. The early day fume hoods used stack height and candles placed on the fireplace smoke shelf to create draft. In the 1800's gas rings replaced candles and eventually fans and electric motors replaced gas rings. Changes, such as adding a front vertical single sash window instead of a hinged door, were eventually instituted. Prior art vertical or combination sash hoods all incorporate a counter balance weight system. Over time, these counterbalancing sash weight systems fail or become difficult to move. Repairing the counter balance weight systems require the fume hood be removed, which requires disconnecting all electrical, plumbing and exhaust services. As this puts the hood out of service for a period of time, the sash maintenance is rarely done. Instead, when the sash is no longer moveable it is blocked open with the counter weight balancing system abandoned in place.

In the 1940's a back exhaust baffle system and streamlined shape "picture window" entrance and work surface airfoil were introduced to all hoods, as illustrated in FIG. 1. Early prior art fume by-pass hood 10 has a vertical moveable sash 18 and a picture window utility post 17. There is a rear baffle conduit 28 with a manually adjusted lower slot 36, a fixed center slot 34, and manually adjusted upper or top slot 32. An exhaust duct 38 is shown on top of the hood and a work surface airfoil 22. Because prior art fume hoods only considered face velocity, no thought was given to the uneven back baffle 28 energy distribution caused by the very narrow but wide plenum design, and its negative effect on internal airflow patterns. The sole purpose for the back baffle was to create a flat face velocity, which was subsequently found to be an ineffectual design premise. Prior art fume hood picture window design posts, utility water and gas handle silhouettes and vertical and or horizontal sash guide channels, all contributed to cause localized eddies and airflow reversals to form at the utility post openings. In the 1950's, an air bypass diffuser 31 was added above the sash opening in an attempt to produce uniform face velocity with sash closure.

To save energy in the 1960's, un-conditioned auxiliary make-up air was introduced above and around the sash perimeter. U.S. Pat. Nos. 3,025,780; 3,111,077; 3,218,953; 3,254,588; 4,177,717; 4,436,022 and 6,080,058 describe various methods used in introducing un-conditioned outside auxiliary make up air into a fume hood. One example of an auxiliary make up fume hood design is shown in FIG. 2. The outside air supply duct 39 is attached to the full width supply plenum 40. There is a vertical full width perforated distribution diffuser 41 in the supply plenum 40 along with air turning vanes 42. The supply velocity into the supply slot is 250-300 fpm. The maximum auxiliary air supply volume is about 50% of the exhaust volume. The utility post 17 is 6 inches minimum. The depth of these prior art fume hoods were sized so they could be carried through an average door and placed on a 30" deep by 36" high bench with an overall height limited to the average nine and one half foot ceiling. The height and depth of the hoods made today are virtually the same size as were made sixty years ago. Fume hood depth and aisle spacing requirements tend to drive laboratory building column spacing, building size and construction cost. Narrow fume hoods cost less to manufacture and save building construction costs by allowing narrower 9-to-10 foot column spacing. Manufacturers would vary hood lengths and sash openings, but such accommodations made no functional difference.

To address rising energy costs in the early 70's, horizontal sashes were introduced to reduce the size of the sash opening. The prior art horizontal sash fume hoods used either a single track or two track configuration. The prior art lower horizontal sash panels were guided in friction channels located in the sash handle and used either rollers or a friction channel upper track as guides. The sash handle channel tracks are prone to chemical attack and collect debris, thereby preventing movement and creating turbulence as the horizontal sash is opened. Unfortunately, the prior art horizontal sash was directed toward energy savings, not worker safety. The problem with the prior art horizontal single and two track designs was that they required sash panel widths wider than workers could put their arms around to be used as a full body shield; this was a particular problem for shorter workers. Additionally, individual fume hoods are often used by two or more workers at the same time and prior art horizontal sash hoods cannot accommodate multiple workers. As a result, such prior art horizontal sash design encourages workers to work in front of an open sash with no splash or explosion protection.

The industry long operated under the erroneous assumption that the fume hood rear baffle slot adjustments were based on the fume hood's air density. The theory was to open the top slot when using lighter than air fumes and open the bottom baffle slots for heavier-than-air-fumes. Prior art patents U.S. Pat. Nos. 3,000,292; 3,218,953; 4,177,717; 4,434,711; 4,785,722; and 5,378,195 describe baffle adjustments and design based on these theories.

FIG. 3, which can be found in the 1999 American Society of Heating Refrigeration and Air-Conditioning Engineers (ASHRAE) engineering handbook on laboratories, illustrates the industry's perception at that time of the airflow patterns of a typical prior art face velocity capture hood to be laminar airflow. It shows laminar air 27 pattern with no vortex when vertical movable sash 18 in the raised position. In fact, U.S. Pat. Nos. 4,280,400 and 4,785,722 describe fume hood designs to eliminate vortexes from forming. Subsequent studies by Robert Morris, which resulted in several patents, provided a reversal to previously held theory that the fume hood design required eliminating or at least minimizing any vortex from forming within the fume hood. Such studies prompted ASHRAE to remove the laminar airflow FIG. 3 from their 2003 engineering handbook on Laboratories.

U.S. Pat. No. 5,697,838 to Morris taught that a fume hood effectively contained fumes when the vortex was stable and fully developed. Vortexes can be further described as developing from mono-stable to bi-stable. A mono-stable vortex is elliptical shaped and attaches to a surface as an air stream is directed across that surface. The elliptical shape is caused by a pressure gradient that forms across the vortex bubble which deforms the vortex. The mono-stable vortex has pulling and lifting forces but is restricted to amount of air volume it can sustain before it becomes unstable. A bi-stable vortex is symmetrical in shape and attaches to two or more surfaces. The bi-stable vortex has better memory and little force but can sustain a greater air volume and still remain stable. Because of cost advantages of making prior art fume hoods narrow, prior art fume hoods do not create stable vortexes throughout sash movement unless the baffle slot velocities and exhaust air volumes are automatically controlled. U.S. Pat. No. 5,924,920 to Morris et al. taught how a fume hood could be designed to form a bi-stable vortex at a full open sash and then to a mono-stable vortex as the sash is closed. One disadvantage was that fume hoods constructed according to the formula of U.S. Pat. No. 5,924,920 are required to be made deeper.

Robert Morris, inventor of U.S. Pat. Nos. 5,697,838 and 5,924,920, published studies indicate that 90% of prior art fume hood spillage appears as puffs at the sash handle which linger at the sash handle when the vortex collapses. FIG. 4A and FIG. 4B illustrate what occurs when the vortex collapses and turbulence occurs. FIG. 4A shows a containing hood with a mono-stable vortex 2. FIG. 4B shows a non-containing hood with an undefined vortex 3', turbulence 21, and chemical spillage 4. This issue becomes a greater health risk for the less than average 5'8" worker. Designers misinterpreting the observation of fume hood smoke pattern testing led prior art fume hood designers to focus on the face velocity and the elimination of the vortex.

In fact, however, it is during the collapse of the vortex that a hood fails to contain fumes. When the vortex fully stabilizes, the fume hood contains fume vapors. The misunderstanding of the importance of a stable vortex lead designers of prior art fume hoods to locate the introduction of bypass diffuser air above the sash handle (FIGS. 1, 3 and 4) directly into the upper vortex-forming chamber. Introduction of bypass diffuser air above the sash inhibits a stable vortex from forming within the vortex chamber and creates varying airflow patterns with sash movement.

Prior art fume hood designs are based on commonly held notions that a constant face velocity captures fumes thereby preventing spillage and should be maintained with sash window opening and closing by locating the bypass diffuser above the sash opening and controlling the exhaust airflow volume. Fume hoods based on these designs eliminate a stable vortex from forming. Additionally, prior art fume hoods baffle slots are adjusted based on fume air density, and the work surface airfoil directs air across the work surface towards bottom baffle exhaust slot. These design assumptions, as well as others, are not accurate because they fail to address the optimum airflow, and therefore the required face velocity and internal airflow patterns to prevent fume spillage through containment of the toxic fumes.

SUMMARY OF THE INVENTION

EPA studies indicate that if only one half of our prior art population of hoods could be fixed to provide the energy savings of high performance low airflow fume hoods our nation would save 235 trillion BTU's of energy per year. This is equivalent to the energy used by 6.2 million households. There is a need to convert prior art fume hoods into high performance low airflow fume hoods without increasing its depth or decreasing the exhaust airflow volume below the lower explosive purge limit.

The present invention describes a work surface airfoil that combines the hood's bypass diffuser and a dynamic turning vane airfoil (BDTVA) to support the development of a stable vortex with sash movement by introducing bypass diffuser airflow into the fume hood following the principals of conservation of momentum. The bypass diffuser airflow exiting the angular and multiple slotted airfoil must merge with, and turn the fume chamber circulating stable vortex towards the baffle slots to support a rotational pattern with minimum turbulence while expanding or contracting the volume of the stable vortex with sash movement. The work surface airfoil BDTVA works in combination with the tear drop sash handle design that will support the required Effective Reynolds number (ERe) and take into account the liner roughness condition. This low turbulence design minimizes Bunsen burner flame-outs and allows for even sensitive powder weighing measurements using sensitive triple beam electronic scales within the fume hood, all problems with prior art fume hoods. This design also eliminates the varying velocity and static pressure losses normally encountered with prior art fume hoods as the sash is moved.

These varying velocity and static pressure losses in prior art fume hoods create varying exhaust airflows with sash movement. To overcome these varying exhaust volumes, prior art fume hoods require expensive and high maintenance duct mounted exhaust airflow volume controls. As described herein, a method of converting existing fume hoods is provided that eliminates these varying velocity and static pressure losses. The need for these airflow controls is eliminated and the fume hoods can now be simply locally or remotely hard balanced using a communication system, supporting today's Green Building Counsels Leadership in Energy and Environmental Design (LEED) energy efficient, sustainable and maintainable green laboratory design program.

The present invention converts a prior art fume hood into a high performance low airflow stable vortex fume hood without increasing the fume hoods depth or decreasing the exhaust airflow volume below the minimum lower explosive purge rate limit.

The present invention includes a mathematical method to determine the required ERe to determine all the design elements of the vortex chamber turning vane, vortex bypass conduit air volume, work surface airfoil bypass diffuser and dynamic turning vane design (BDTVA), rear baffle lower corner slot design and control sequences to create a high performance low airflow stable vortex fume hood without empirical field trial and error testing.

The present invention converts prior art vertical and or combination vertical/horizontal single and dual track sash hoods into triple track horizontal or combination vertical and triple track horizontal sash hoods permitting simultaneous multiple worker access. The sash windows use clear polycarbonate material which improves worker safety and acid resistance over standard safety glass that is supported by guided rollers on the top and one or two removable tab guides that insert in the sash handle allowing for easy sash window cleaning and hood loading.

The present invention incorporates a non-pinch point teardrop shaped sash handle design with low surface drag coatings, such as Dupont Teflon, that shed eddy airflow reversals and vortexes from forming in both vertical and horizontal sash operation with streamline airflow patterns on all surfaces including self-cleaning horizontal sash panel guide slots that also eliminate surface eddies from forming.

The present invention incorporates an exhaust damper assembly which can be inserted from within an existing prior art fume hood exhaust connections that includes an inlet nozzle, airflow measuring probe for local and or remote metering and balancing communication system, low pressure drop 15:1 turndown linear damper that rejects up-stream duct generated turbulence and overcomes baffle conduit static pressure variations.

The present invention includes conversion kits that include all necessary components to convert any style existing prior art fume hood into a stable vortex high performance low airflow fume hood that can accommodate varying size prior art fume hoods without altering the fume hood envelope or customizing the conversion kit. The articulating rear baffle can be lifted out for cleaning debris that collects in baffle conduit. The conversion can be accomplished without drilling mounting holes into an asbestos liner and can be applied on any size or style prior art fume hood.

The present invention embodiments can be incorporated within a new fume hood envelope to create a horizontal or combination sash high performance low airflow stable vortex hood without making the fume hood deeper than a standard bench cabinet or reducing the exhaust airflow below the lower explosive limit.

BRIEF DESCRIPTION OF THE DRAWINGS

FIG. 23C-23E provide charts to determine positioning and sizing of the teeth on the preferred damper design.

DETAILED DESCRIPTION

Figure 1:
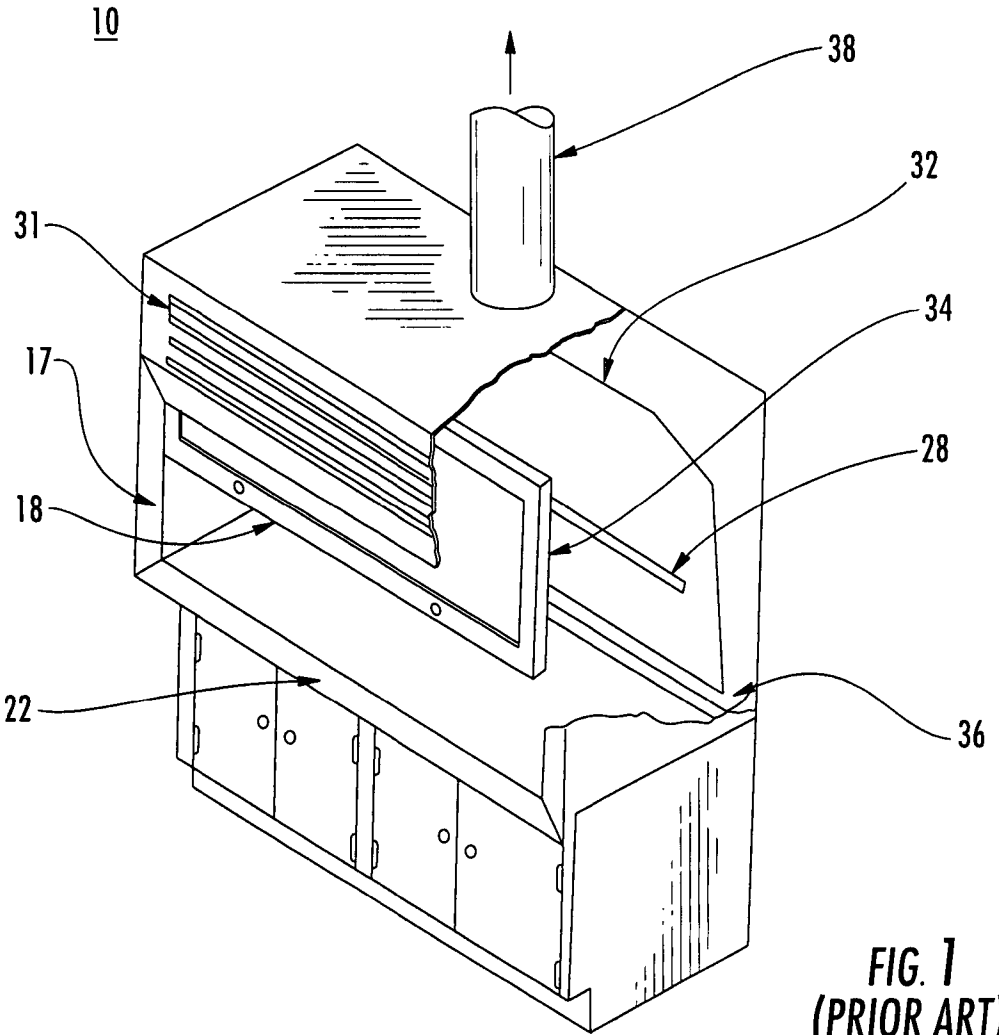
FIG. 1 (PRIOR ART)
FIG. 1 illustrates a prior art hood with a back exhaust baffle system and streamlined shape "picture window" entrance and work surface airfoil.
Figure 2:
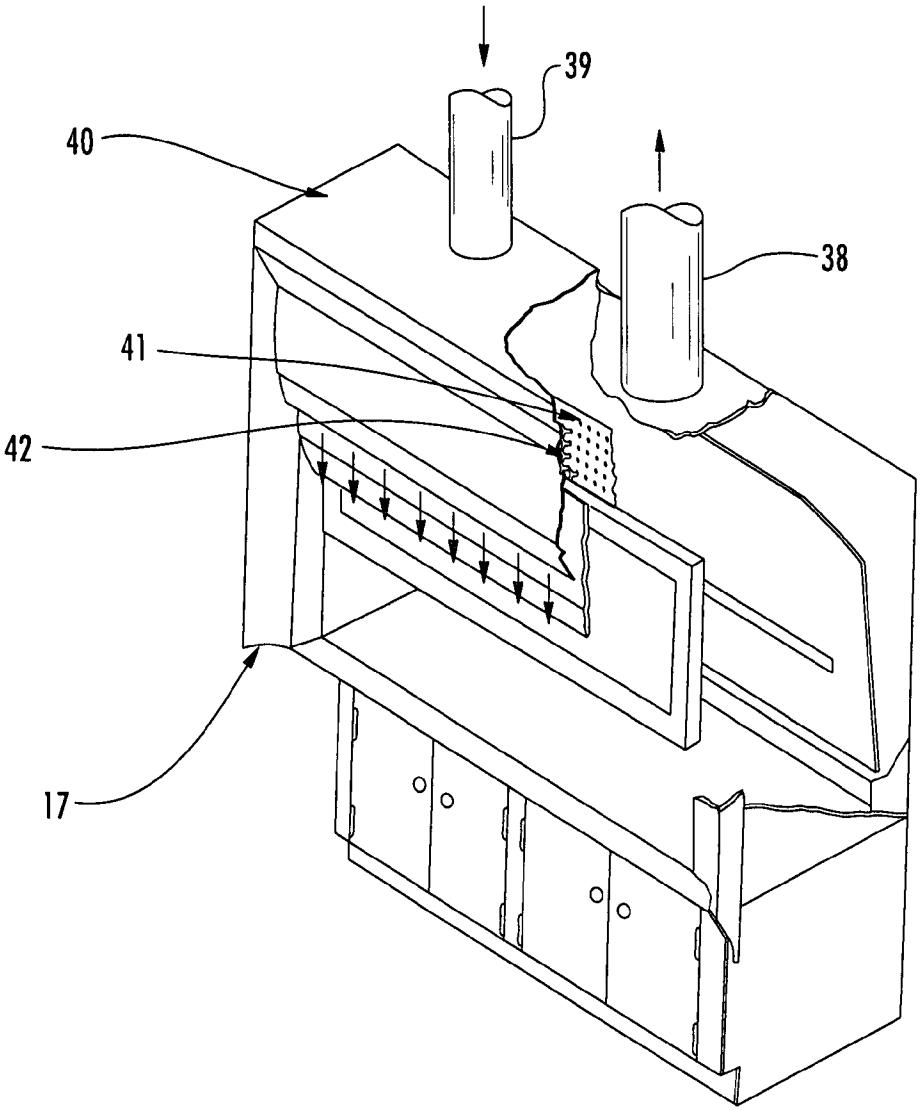
FIG. 2 (PRIOR ART)
FIG. 2 illustrates a prior art hood with an auxiliary make-up fume hood design.
Figure 3:
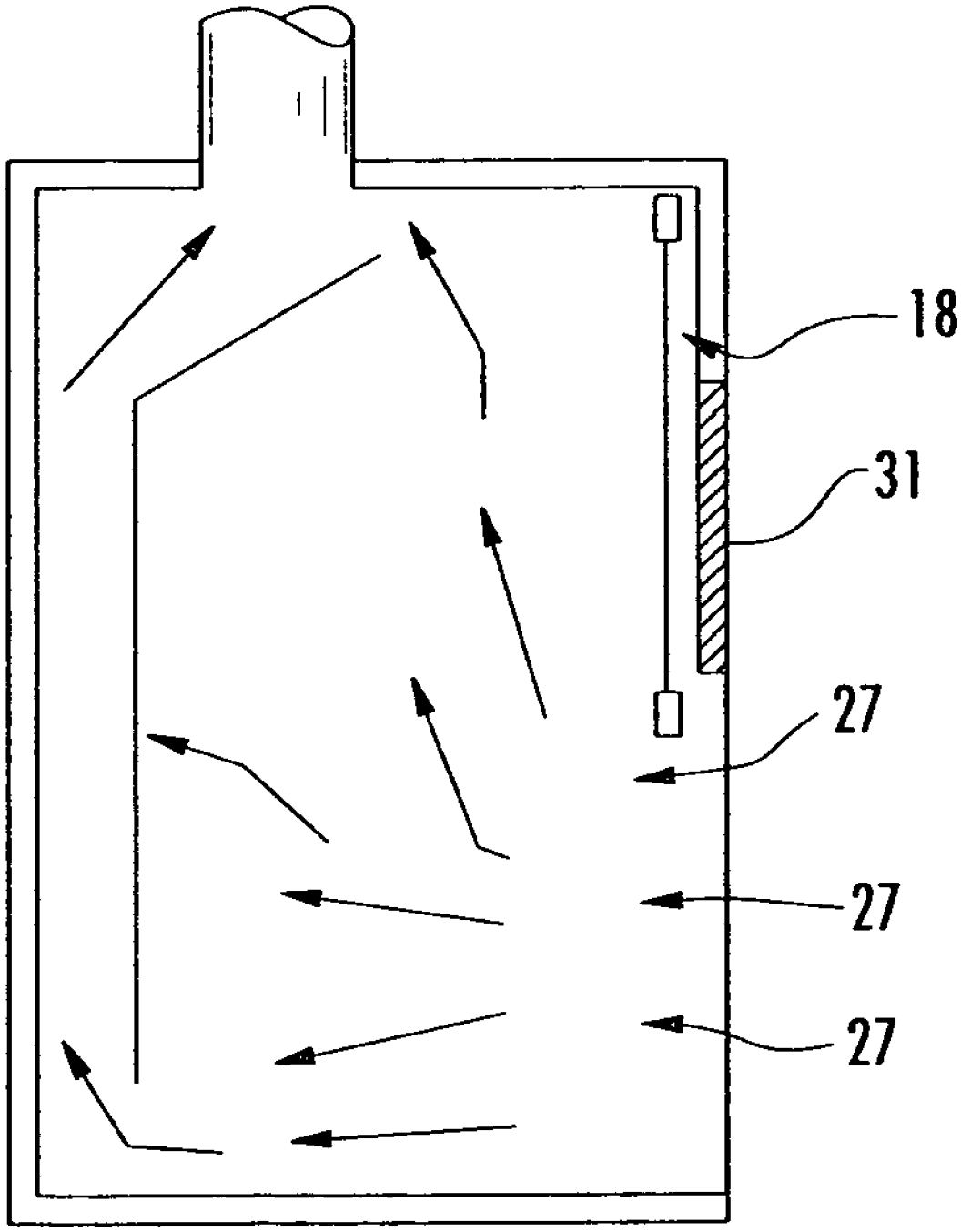
FIG. 3 illustrates the industry's perception of the airflow patterns of a typical prior art face velocity capture hood.
Figure 4B:
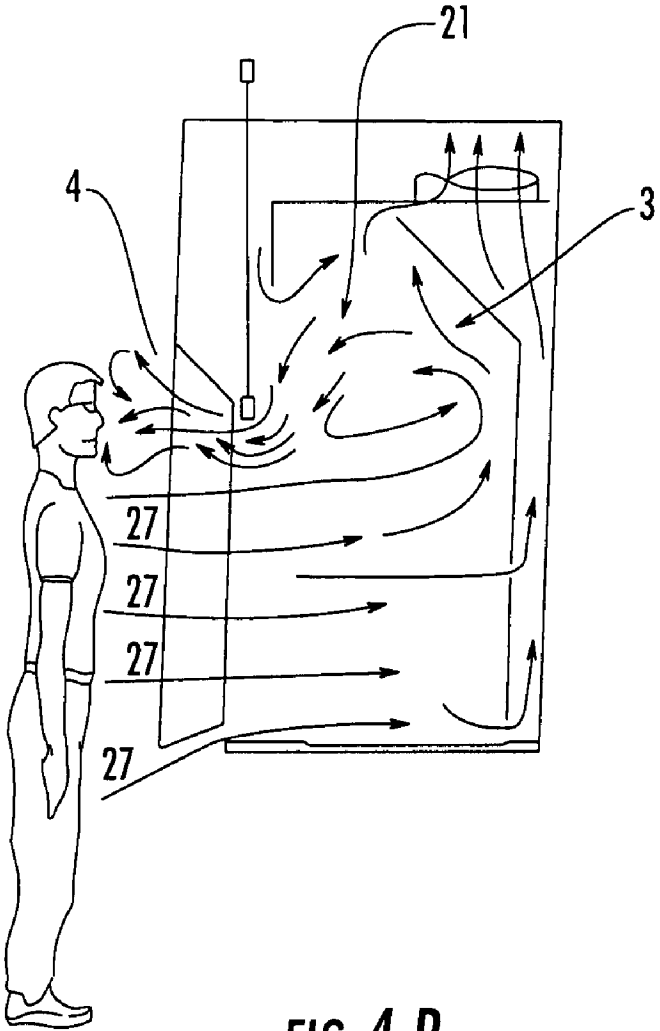
FIGS. 4A and 4B illustrate what occurs when the vortex is undefined and turbulence occurs.
Figure 4A:
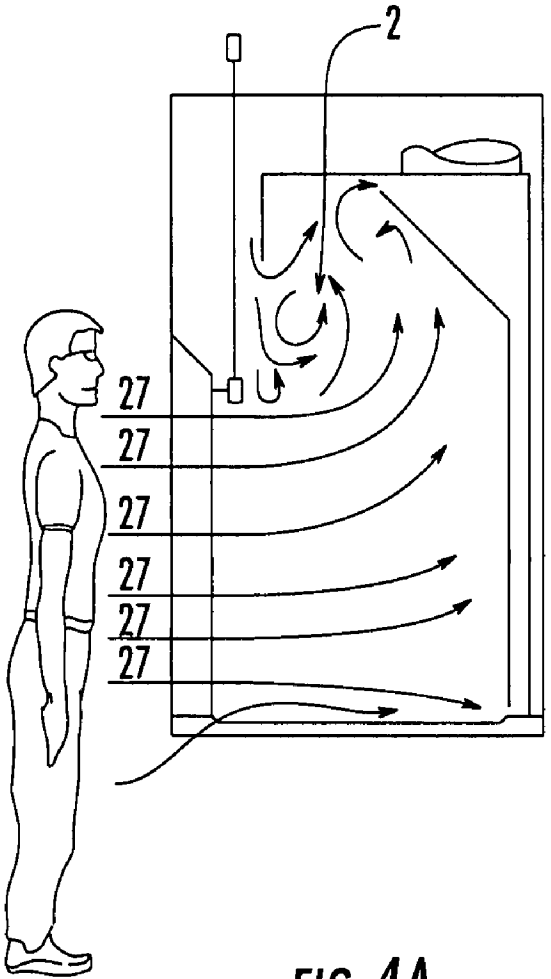

Definitions:

Access Opening: That part of the fume hood through which work is performed; sash or face opening.

Actuable Baffle: A rear baffle system comprised of multiple dampers allowing for either manual or controlled transfer of a constant exhaust air volume by modulating slot opening and closing system Airfoil: A horizontal member across the lower part of the fume hood sash opening. Shaped to provide a smooth airflow into the chamber across the work surface.

Baffle or Rear Baffle: Panel located across the rear wall of the fume hood chamber interior and directs the airflow through the fume chamber.

Balancing: In an air conditioning system is the process of measuring the as installed airflow values and making any adjustments to achieve the design intent.

Bypass: Compensating opening in a fume hood to limit the maximum air flow passing through the access opening and or vortex chamber.

Combination Sash: A fume hood sash with a framed member that moves vertically, housing horizontal sliding transparent viewing panel or panels.

Commissioning: In an air-conditioning system it is a process of ensuring that systems are installed, functionally tested and capable of being operated and maintained to perform in conformity with the design intent.

Communication System: A control method to maintain a constant fume hood exhaust airflow thru either remote manual adjustment, shared transducer auto scanning and sequencing or dedicated control of the exhaust airflow or static pressure.

Conduit: In an air conditioning system a closed channel intended for the conveyance of either supply or exhaust air.

Damper: A device used to vary the volume of air passing through an air inlet slot, outlet slot or duct.

Dead Time or Lag Time: The interval of time between initiation of the input change or stimulus and the start of the resulting response.

Differential Pressure: The difference between two absolute pressures.

Diffuser: An air distribution system consisting of deflecting mechanism discharging air in various directions and planes to promote mixing of the air supplied into the fume chamber.

Double or Dual Horizontal Sash: Sash frame with two upper supports and two bottom supports for dual horizontal sliding transparent viewing panels.

Dynamic Turning Vane: An active non-physical structure using air jets to turn air in a plenum chamber at an angle at a point where airflow changes direction. Used to promote a more uniform airflow to reduce velocity and static pressure losses caused from turbulence.

Effective Reynolds Number: A Reynolds number required to achieve the condition the conditions to sustain a stable vortex in the vortex chamber of a fume hood.

Face or Sash Opening: Front Access opening of laboratory fume hood face opening area measured in width and height, formed through a movable panel or panels or door set in the access opening/hood entrance. See access opening.

Face Velocity: Average speed of air flowing expressed in feet per minute (FPM) perpendicular to the face opening and into fume hood chamber equal to the square root of the fume hood's chambers lower than atmospheric static pressure times 4003 to correct to average laboratory environmental conditions.

Flow Coefficient: A constant (CV), related to the geometry of a valve or damper, of a given valve or damper opening that can be used to predict flow rate.

Fume Chamber: The interior of the fume hood measured width, depth and height constructed of material suitable for intended use.

High Performance Low Airflow Hood: LEED defined hood using a maximum 50 CFM/square foot exhaust air volume, and passing the ASHRAE tracer gas test with a less than 0.05 PPM spillage at 4 LPM tracer gas release rate.

Laminar: Airflow in which air molecules travel parallel to all other molecules; flow characterized by the absence of turbulence.

Plenum Chamber: In an air-conditioning system an enclosed volume which in an exhaust system is at a slightly lower pressure than the atmosphere and slightly higher in a supply system.

Pressure Transducer, Differential Pressure Transducer or Transducer: An Electromechanical device using either electronic techniques to sense pressure through distortion or stress of a mechanical sensing element and electrically convert that stress or distortion into a pressure electronic signal; or thermal conductivity gage known as non-limiting list of thermocouple, thermistor, pirani, and convection gages. These gages may have a sensor tube or element array with a small heated element and or multiple temperature sensor or sensors. The temperature of the heated element and a temperature sensor varies proportionally to the thermal conductivity of the air passing by or through the sensor as differential pressure varies and electrically converts sensor temperature variations into a pressure electronic signal.

Single Horizontal Sash: Sash frame with a single upper support and bottom support for a single horizontal sliding transparent viewing panel.

Total Pressure: The sum of velocity pressure and static pressure.

Triple Horizontal Sash: Sash frame with three upper supports and three bottom supports for triple horizontal sliding transparent viewing panels.

Turning Vane: A passive physical structure placed in a plenum chamber at an angle at a point where airflow changes directions; used to promote a more uniform airflow to reduce velocity and static pressure losses caused from turbulence.

Vortex Pressure or Vortex Total Pressure: The sum of vortex velocity pressure and static pressure.

Overview

A method to convert existing prior art fume hoods into high performance low airflow stable vortex fume hoods is provided. The method can be performed in the field on the site of the existing fume hood and can be accomplished without increasing the fume hood's depth. The same techniques are also implemented in the design and manufacture of new high performance low airflow stable vortex fume hoods, where the narrow depth can accommodate narrow laboratory column and aisle spacing. The present invention provides a number of features that work together or separately to provide a stable vortex and eliminate or minimize random hood turbulence that causes spillage.

Effective Reynolds Number Calculation

To solve for fume hood random turbulence, the fume hood's Effective Reynolds Number (ERe) must be calculated. The Reynolds Number (Re) at a point in fluid stream is the ratio of inertia force to viscous shearing force acting on a hypothetical particle of fluid at that point. The Reynolds Number is a function of characteristic linear dimension of the boundary surface (D), the relative velocity of the particle and that surface (V), and the physical properties of fluid as represented by the absolute viscosity (μ) and mass density (p).

$$Re=DVp/\mu$$

Re is a force ratio, which can be used to determine similar flow patterns that take place when there are geometrically similar flow boundaries. Operational Re of existing prior art fume hoods vortex chamber and their liner coefficient of friction roughness influences all design criteria, as described below, will achieve the required ERe to create the condition to sustain a stable vortex.

Figure 6:
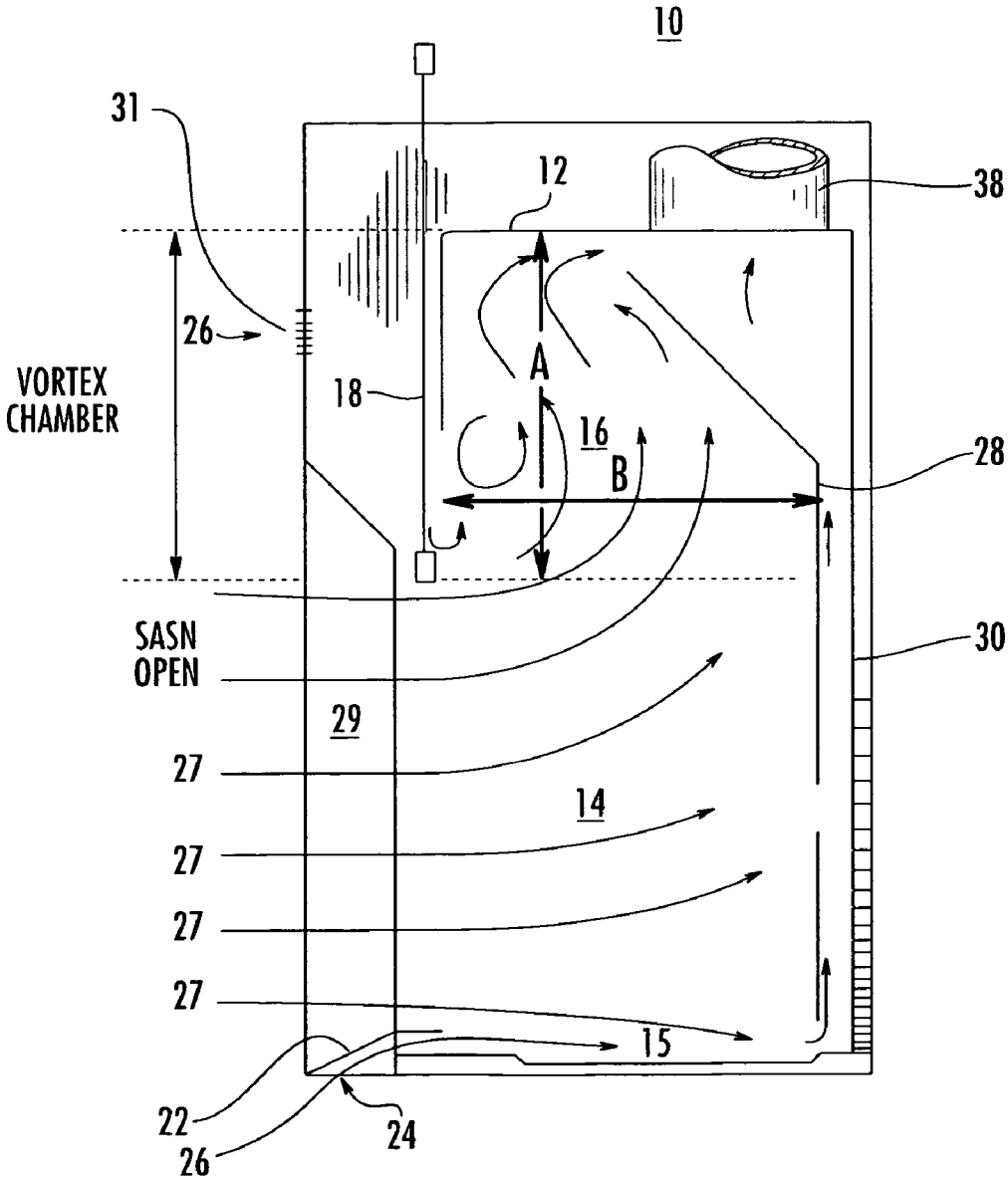
FIG. 6 (PRIOR ART)
FIG. 6 illustrates the side view of a typical prior art fume hood with sash fully open.

A set of computations are provided to determine the operation method to convert, preferably on site, any size existing fume hood into a stable vortex hood, optionally with predetermined adjustments required over time for liner deterioration. FIG. 6 illustrates the side view of a typical prior art fume hood 10 with a sash 18 fully open. The prior art fume hood 10 has a fume chamber 12 containing a working space 14 having a work surface floor 15, a vortex chamber 16 generally above working space 14, a vertically-slidable sash window or door 18, an airfoil 22 defining a bottom stop for sash 18 and a work surface airflow sweep entry 24 for admission of make-up air 26 thru both bypass diffuser 31 and airfoil 22 when sash 18 is closed. When sash 18 is open, air 27 is drawn thru access opening into enclosure 12 through the sash opening 29. Within enclosure 12 is a baffle 28 off-spaced from the back wall 30 of enclosure 12 to form a rear baffle conduit, which communicates with an exhaust duct 38 leading to an exhaust fan (not shown). Dimension A and B define the height (A) and depth (B) of the vortex chamber with full sash opening.

Step No. 1: Calculation of the Vortex Chamber Boundary (VCB). The following equation is solved using the dimensions obtained from the hood to be converted, where A and B are in inches.

$$VCB = \frac{2(AB)}{A+B}$$

Step No. 2: Convert the VCB to square feet (sq. ft.)

$$\frac{0.785(VCB^2)}{144} = VCB \text{ sq. ft.}$$

Step No. 3: Determination of the minimum fume hood lower explosive purge limit exhaust airflow in cubic feet per minute (CFM): In the preferred embodiment, the minimum value used is the National Fire Code (NFPA) Chapter 45 required 25 CFM per square foot of work surface, or 50 CFM per linear foot of fume hood, whichever value is greater. This value is the fume hood exhaust (FHE). A greater exhaust flow can be used depending on heat load requirements of the laboratory, with a preferred LEED maximum of about 50 CFM per square foot of work surface area. A lower exhaust flow is not preferred as it may jeopardize the safety of the user of the hood.

Figure 7:
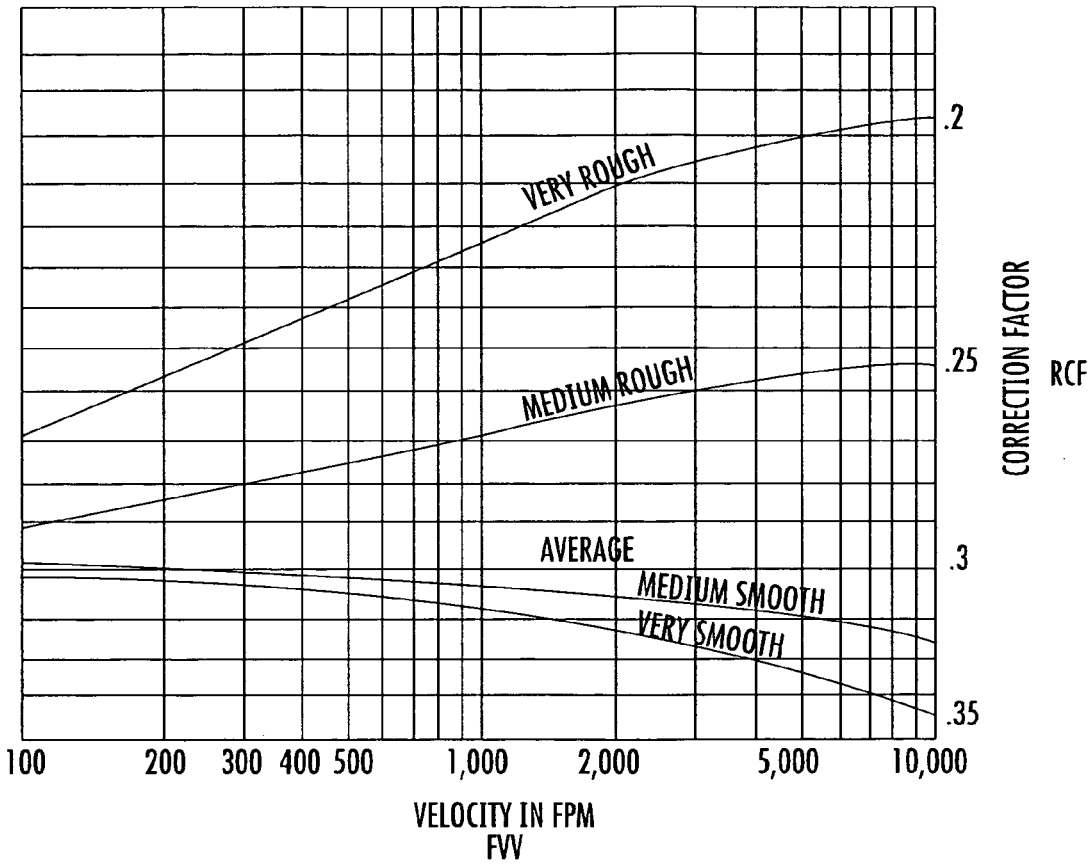
FIG. 7 is a chart for determining the Roughness Correction Factor.

Step No. 4: Calculation of the fume hood vortex velocity (FVV) in feet per minute (fpm) using the values obtained from Step 2 and Step 3.

$$\frac{FHE}{VCB\,\text{sq. ft.}} = FVV \text{ (see FIG. 7)}$$

Step No. 5: Calculation of vortex chamber airflow (VCA) using the value obtained in Step 3 and the fume hood linear coefficient of roughness correction factor (RCF). The FVV value obtained in Step 4 is the X-axis value in the chart and the coefficient of roughness of the fume hood liner material surface that best corresponds to the industry standard roughness conditions for various pipes provides the intersection point to determine the RCF, which is the Y-axis. As a result the RCF for a given FVV is different for varying liner roughness surfaces.

Those skilled in the art will readily determine the roughness. One method involved the absolute roughness (ϵ). Every surface, no matter how polished, has peaks and valleys. The mean distance between the distance between these high and low points is the absolute roughness. The following table, Table 1, which can be used as a guide to determining roughness, gives examples of the various roughness conditions along with an example of a typical surface with that roughness.

TABLE 1

| Condition | Typical Surface | Average ∈ | Range ∈ |
|---|---|---|---|
| Very smooth | Drawn tubing | .000005' | — |
| Medium smooth | Aluminum duct | .00015' | .00010'-.00020' |
| Average | Galvanized iron duct | .0005' | .00045'-.00065' |
| Medium Rough | Concrete pipe | .003' | .001'-.01' |
| Very rough | Riveted steel pipe | .01' | .003'-.03' |

$$(RCF)(FHE)=VCA$$

Step No. 6: Calculation of the vortex chamber velocity (VCV) in fpm using the VCA value from Step 5 and the VCB sq. ft. value from Step 2.

$$\frac{VCA}{VCB} = VCV$$

sq. ft.

Step No. 7: Calculation of the vortex chamber Reynolds Number (VCRe) using the VCV value from Step 6 and the VCB sq. ft. value from Step 2. 8.6 is a constant based on the equation for the Reynolds number reduced except for velocity and diameter.

$$VCRe=8.6(VCV)(VCB)$$

Figure 8:
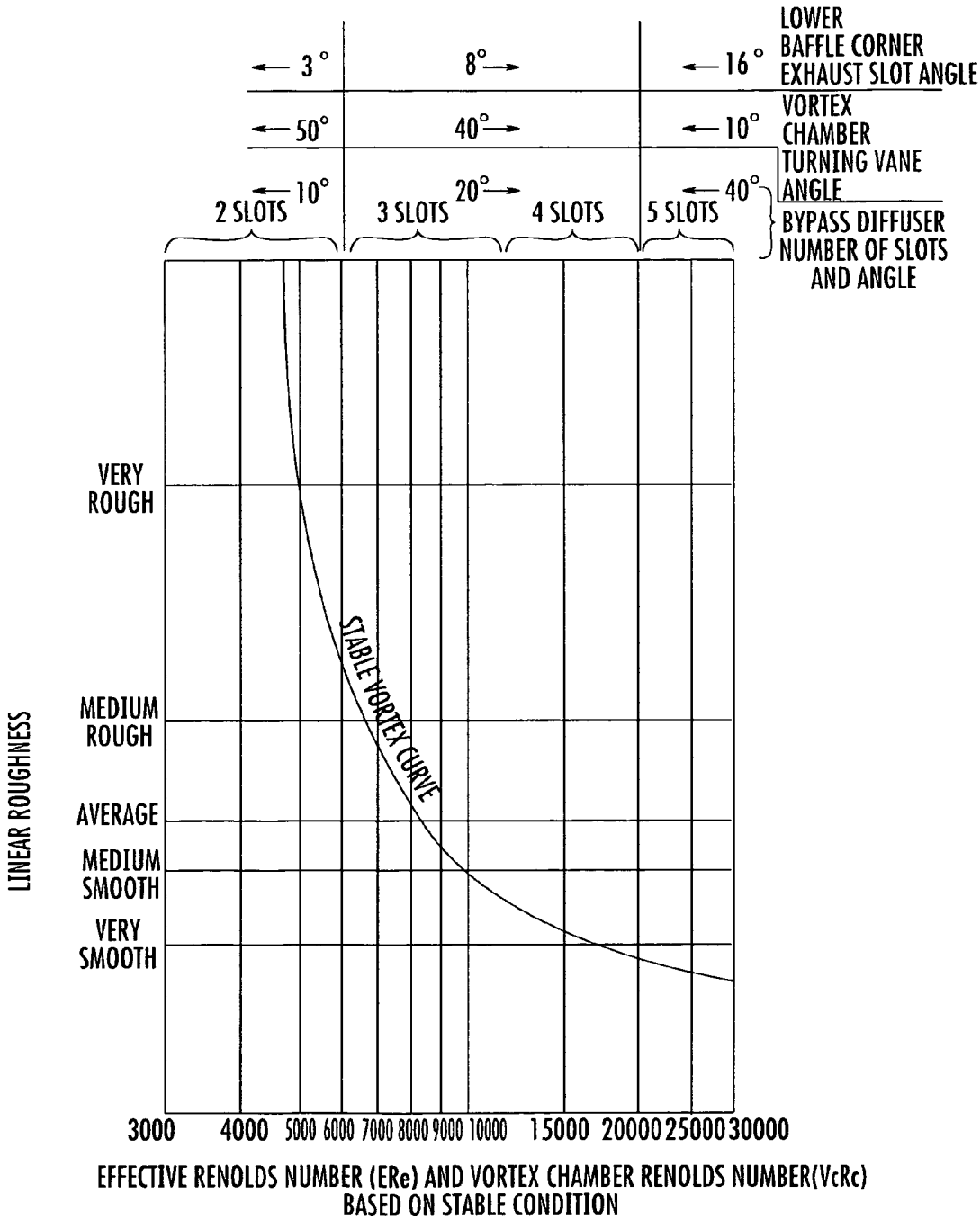
FIG. 8 is a chart for determining the configuration for the conversion of prior art hoods into high performance low airflow hoods.

FIG. 8 graph is used to determine the number of bypass diffuser slots, and the angle of dynamic turning vane angle, the lower baffle corner exhaust slot angle and the amount of vortex bypass conduit (VBA) airflow in CFM. FIG. 8 X-axis represents both the calculated VC Re and required E Re values. A vertical line drawn to the top of FIG. 8 from the X-axis VC Re value indicates the bypass diffuser's number of slots and the angle of these slots to create the dynamic turning vane (BDTVA), the vortex chamber turning vane and lower baffle exhaust slot angles. Where the stable vortex curve in FIG. 8 intersects the representative liner roughness on the Y-axis and corresponding ERe value on the X-axis becomes the required ERe. If the VC Re is less than the ERe then no vortex bypass conduit air (VBA) is required. If the VC Re is greater than the ERe the percentage of this difference now becomes the amount of VAF with the difference from the total VCA redirected thru the vortex bypass conduit as VBA.

FIG. 8 also provides guidance for making physical changes to the existing hood to increase the stability of the vortex. The area above the curve represents less stability for the vortex. The area below the curve represents more stability for the vortex. In practice, adjustments should be made to the hood so that hood is at or below the curve. There are various methods for adjusting a given hood to achieve the desired stability.

For example, a hood with a ERe of 10,000 that is medium rough is above the curve. That hood can be correct by physically altering the smoothness of the hood to medium smooth or very smooth. The remainder of the conversion proceeds as per the chart. Specifically, the airfoil would have 3 slots and the angle would be 20°, the vortex chamber turning vane angle would be 40°, and the lower baffle corner exhaust angle would be 8°.

Another correction to bring a particular hood under the curve would be to increase dimension A of the hood. One way of doing this would be to extend the length of A with the addition of a glass panel, or other transparent material. The use of transparent material achieves the purpose of creating the condition for a sustainable vortex but does not sacrifice visibility into the hood. If visibility is not a factor, other material can be used.

Another option that is available but is often not preferred is to increase the B dimension of the hood. In most instances, increasing the depth of the hood will not be desirable as the aisles or fume hood position will not accommodate a deeper hood.

Step No. 8: Calculate the percent of airflow required (AFR %) to sustain the ERe.

$$ERE/VCRe=AFR\%$$

Step No. 9: Vortex airflow (VAF) in cfm required to attain ERe. The AFR % obtained from Step 8 is multiplied by the VCA value from Step 5.

$$(AFR\%)(VCA)=VAF$$

Step No. 10: Vortex bypass conduit airflow (VBA) in cfm is obtained by subtracting the VAF from Step 9 from the VCA value from Step 5.

$$(VCA)-(VAF)=VBA$$

VBA is 0 or Less

As the VBA volume increases from zero airflow to maintain the ERe, the baffle control sequence changes to reflect the change in dynamic conditions and the control response required to maintain a stable vortex. When no VBA is required, then FIG. 9 sequence applies. That is, the hood is converted in accordance with the fume hood illustrated in FIG. 9. A hood assembly enclosure 12 comprises a conventional working chamber 14 having a work surface floor 15, a vortex chamber 16 generally above working space 14. A rear baffle system comprising upper and lower interlocking or hinged, actuable baffles 66 and 68, respectively replace the fixed baffle 28 in the prior art hood or design. Baffles 66 and 68 are each pivotable about a horizontal axis with a middle slot 34 being formed therebetween. Upper slot 32 is formed at the top of baffle 66, and lower slot 36 is formed at the bottom end of baffle 68. A more detailed description of a preferred embodiment of the rear baffle is described below with reference to FIG. 14. An actuator 74 is operationally disposed to turn baffle 66, and baffle 68, in counter directions about their axes to vary simultaneously the size of the three slots and the geometry of the working chamber 14 and the vortex chamber 16. In fume hoods where no VBA is required, a stable vortex can be achieved by proportionally controlling the baffle slot openings 32, 34, and 36 to the change in vortex total differential pressure.

The lower baffle corner exhaust angle 175 is determined in accordance with FIG. 8 and as described below with reference to FIG. 14.

A vortex chamber turning vane 95 is hinged and or fix positioned at an angle N in accordance with FIG. 8. A more detailed description of the installation of the vortex chamber turning vane is provided below with reference to FIG. 15A. Additional features include a vortex total differential pressure transducer 52 communicating to an opening through the sidewall of the vortex chamber 16. As described in U.S. Pat. No. 5,697,838, which is hereby incorporated by reference, the transducer 52 continuously measures the vortex total pressure difference between the vortex chamber and the exterior of hood 20 and causes a controller 56 to proportionally vary the position of dampers 66, 68 and 95 which control the open areas of slots 32, 34 and 36, thereby stabilizing the vortex. As described in the U.S. Pat. No. 5,697,838, this system can maintain a laminar flow thru sash opening 29 into working space 14 and stable vortex with in varying VCB envelope as sash opening 29 is varied opened or closed. The vortex total pressure transducer signal can also be directed to an alarm to signal an off-standard and potentially dangerous condition, which may have variable threshold discriminators to provide predetermined alarm limits.

In one embodiment, the transducer comprises an electronic balancing bridge including a sensor for detecting variations in the pressure difference between the vortex chamber and the exterior of the hood, said sensor being disposed adjacent to a port or connection through a wall of said vortex chamber, said port or connection being located in a portion of the path of said vortex; and operational amplifiers for amplifying signals from said sensor. The amplitude of the signals from the transducer is proportional to the stability of the vortex, and the controller is a feedback control system which controllably varies the amount of air flowing and airflow pattern through the vortex chamber to maximize vortex stability. The control system uses programmed proportional or proportional and integral or proportional, integral and adaptive gain algorithms in processing said signals, and the controller is preferably but limited to an analog computer.

A combination bypass diffuser airfoil (BDTVA) replaces any existing work surface airfoil with the number of diffuser slots and dynamic turning vane angle as determined by FIG. 8.

In operation, the work surface bypass diffusers (BDTVA) make up air exiting the angular and multiple slotted airfoil joins with and turns the stable vortex with minimum turbulence while expanding the volume of the stable vortex towards the rear baffle. This design eliminates the varying velocity and static pressure losses normally encountered with prior art fume hoods.

Additional features may also optionally include one or more of the following features (not shown: 1) a dual non pinch point tear drop shape sash handle design; 2) triple track combination vertical/horizontal or triple track horizontal sash hoods; and 3) an improved exhaust damper assembly. These features are each described more fully below.

VBA is Greater than 0 to 30

Figure 9:
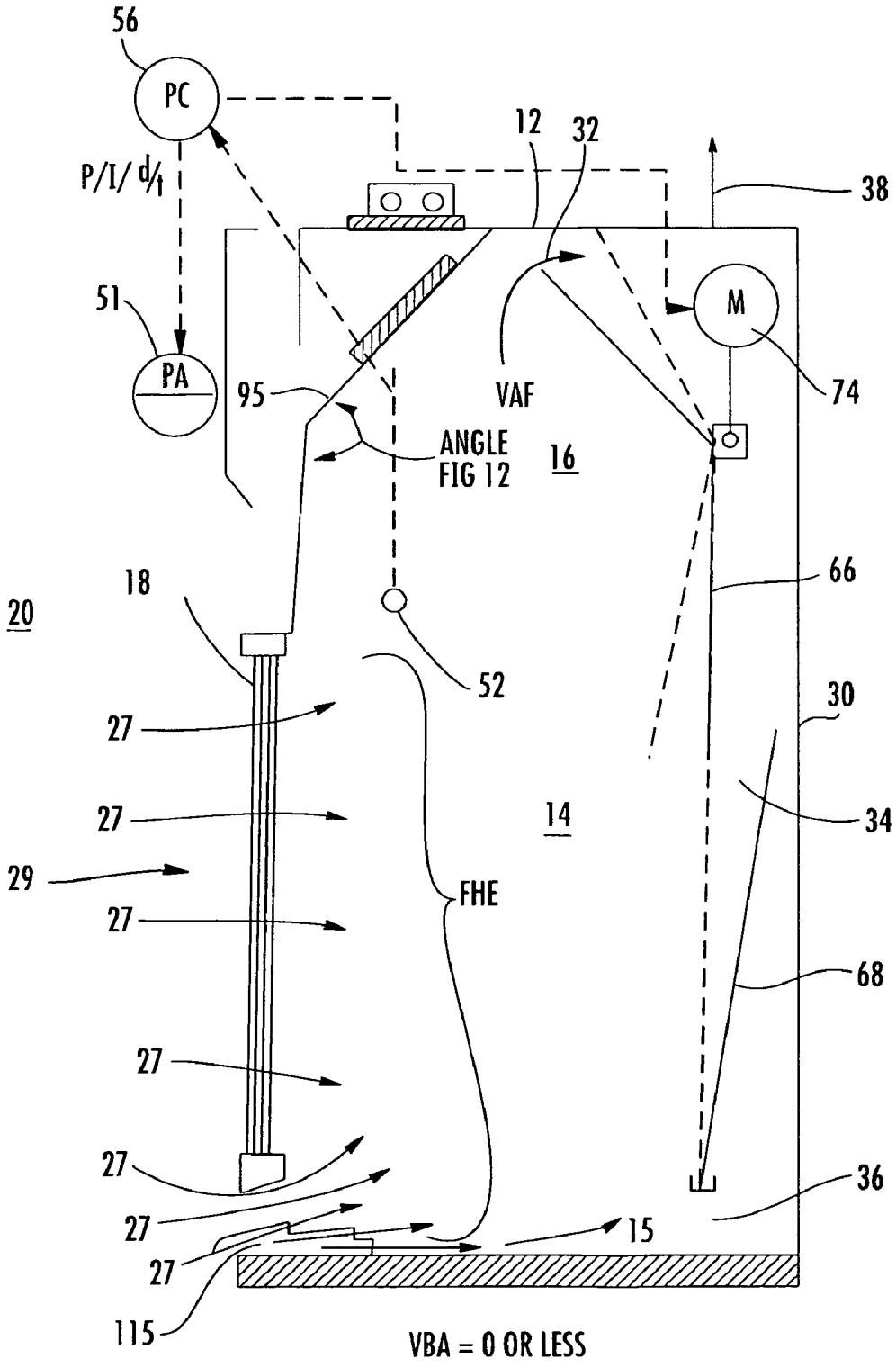
FIG. 9 is the sequence or configuration for converting a prior art hood to a high performance low airflow hood when the prior art hood has a VBA of 0 or less.
Figure 10:
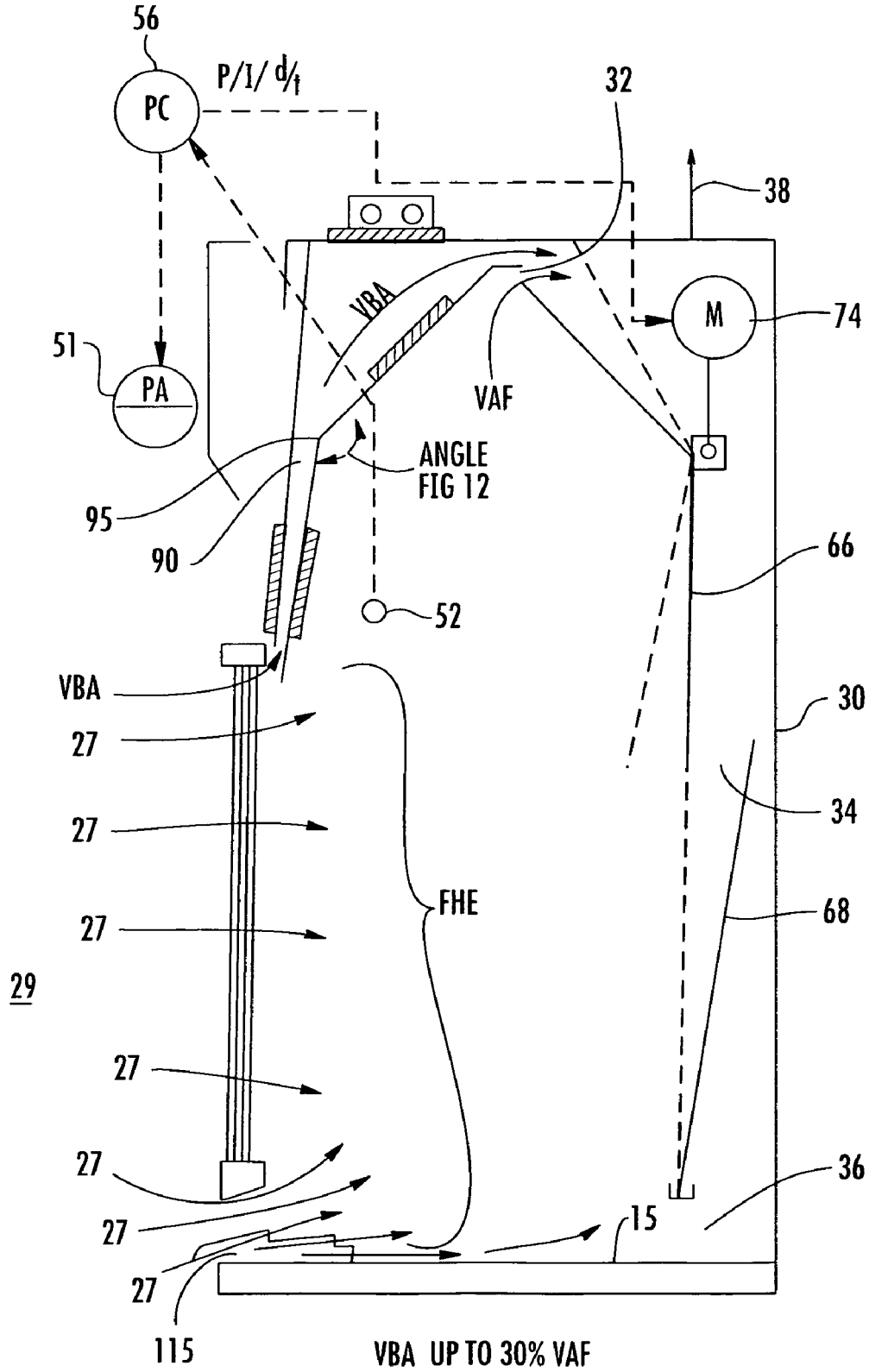
FIG. 10 is the sequence or configuration for converting a prior art hood to a high performance low airflow hood when the prior art hood has a VBA greater than 0 but less than or equal 30%.

As the VBA volume increases from zero airflow to 30% of the VAF volume, FIG. 10 control sequence applies. A rear baffle system is incorporated as in FIG. 9. A vortex bypass conduit 90 is created by the positioning of the vortex chamber turning vane 95, hinged or fixed or either in accordance with FIG. 8 and as described more fully with reference to FIG. 21. The VBA volume proportionally increases as the sash is opened fully and the top baffle slot opens proportionally to a change in vortex total differential pressure. The remainder of the fume hood, along with the optional features, is applied to the control sequence of FIG. 10 as they are described in control sequence of FIG. 13.

VBA is Greater than 30

Figure 11:
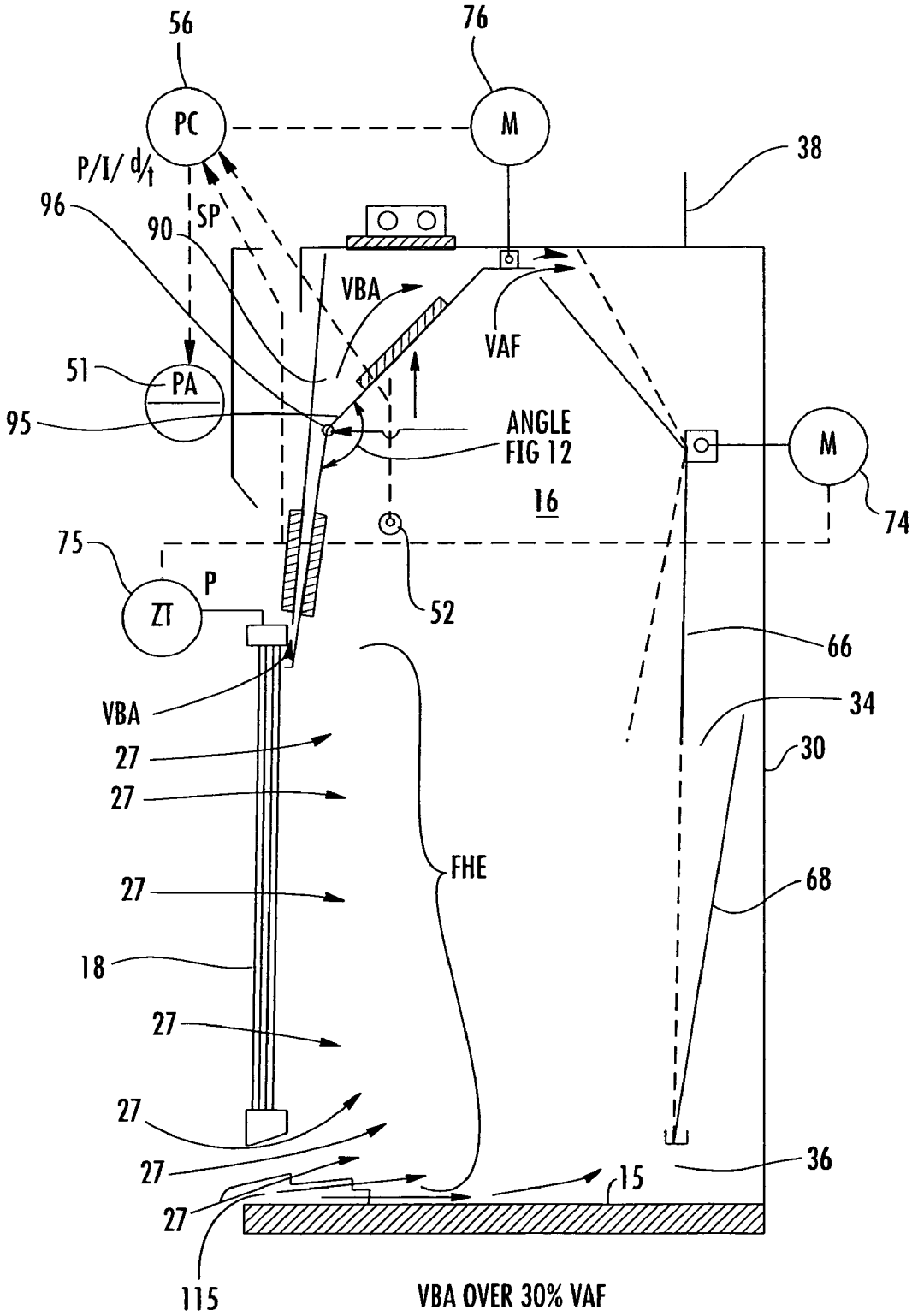
FIG. 11 is the sequence or configuration for converting a prior art hood to a high performance low airflow hood when the prior art hood has a VBA greater than 30%.

As the VBA volume increases above 30% of the VAF volume, FIG. 11 control sequence applies, which includes a VBA turning vane actuator 76 controlling the movement of the hinged 96 vortex turning vane 95. When an existing fume hood requires FIG. 11 control sequence, it indicates that dead time always apart of closed loop control will affect the lag time it takes for the stable vortex recovery as the sash 18 is moved. To minimize the effects of lag time or dead time, FIG. 11 control sequence incorporates a combination feed forward and cascade control loop. The sash 18 total area opening (not shown) is measured by position transducer or transducers 77 monitoring the height and or width of the sash opening using the positions transducers electronic output signal proportional to sash opening using methods known to those skilled in the art, such as position transducers. A non-limiting list of position transducers includes technology using variable resistance, variable reluctance, and variable capacitance, sonic, optical or inferred technology.

The total area of sash opening is calculated from these position transducer 77 outputs and the baffle actuator 74 and slots 32, 34, and 36 then proportionally repositions as the total open sash area increases. The total area sash opening position transducer signal is also feed forward as a cascade set point to the vortex total pressure controller 56. The vortex total pressure controller 56 with proportional, integral and adaptive gain algorithms compares the sash opening to the vortex total pressure transducer 52 input signal and modulates the VBA turning vane actuator 76 and vortex turning vane 95 thereby adjusting the flow through vortex bypass conduit 90 (the VBA) to stabilize the vortex as the sash or sashes are moved. The remainder of the fume hood, along with the optional features, is applied to the control sequence of FIG. 11 as they are described in control sequence of FIG. 9.

Sash Handle and Triple Track Sash Hoods

Figure 5A:
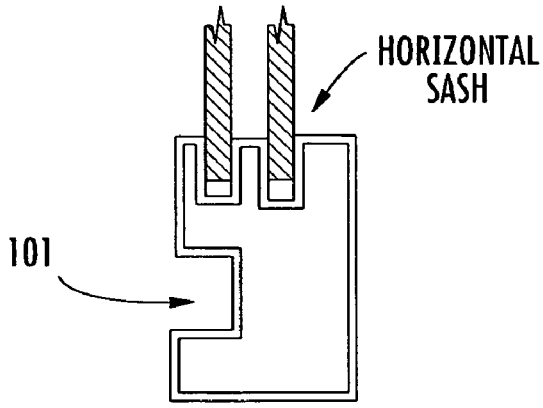
FIG. 5A (PRIOR ART)
FIG. 5A-5E illustrate various prior art sash handles.
Figure 5B:
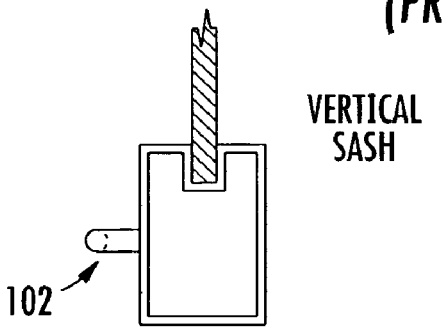
FIG. 5B (PRIOR ART)
Figure 5C:
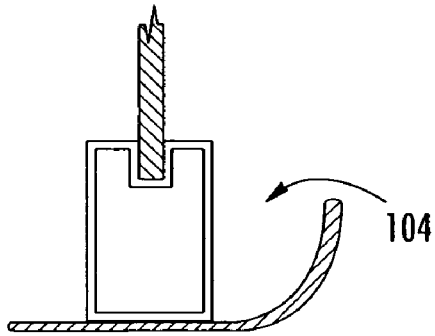
FIG. 5C (PRIOR ART)
Figure 5D:
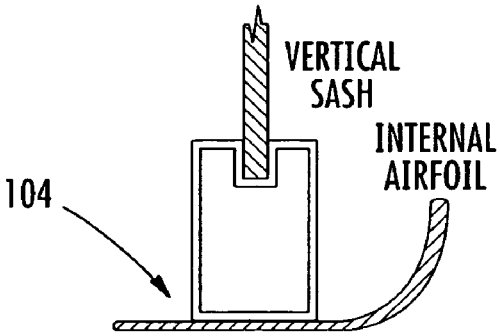
FIG. 5D (PRIOR ART)
Figure 5E:
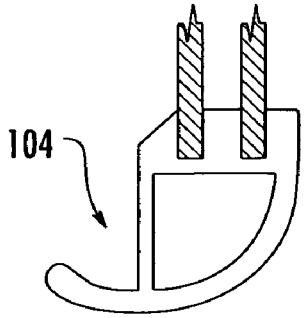
FIG. 5E (PRIOR ART)

90% of the prior art fume hood's chemical laden fume spills are released at their sash handle into workers breathing zone. Prior art fume hood handles, such as those illustrated in FIGS. 5A, 5B, 5C, 5D and 5E favored rectangular sash handles incorporating finger slots. FIG. 5A shows a two channel track horizontal sash with a finger slot 101. FIG. 5B shows a vertical sash with a handle 102. FIG. 5C shows a vertical sash with a dual airfoil and finger pull 104. A different vertical sash with finger pull 104 is shown in FIG. 5D with internal airfoil 104'. Another two channel track horizontal sash is shown in FIG. 5E with a finger pull 104. Such designs can cause a hand pinch point. Moreover, some prior art designs considered aerodynamic streamline airflow beneath the sash handle. Such designs create localized vortexes internally at the sash handle, and induce eddy boundary layer airflow reversals of fumes out of the hood. As the hood loses containment, these prior art handle designs create conditions that promote chemical laden fumes to linger in the workers' breathing zone.

Figure 12:
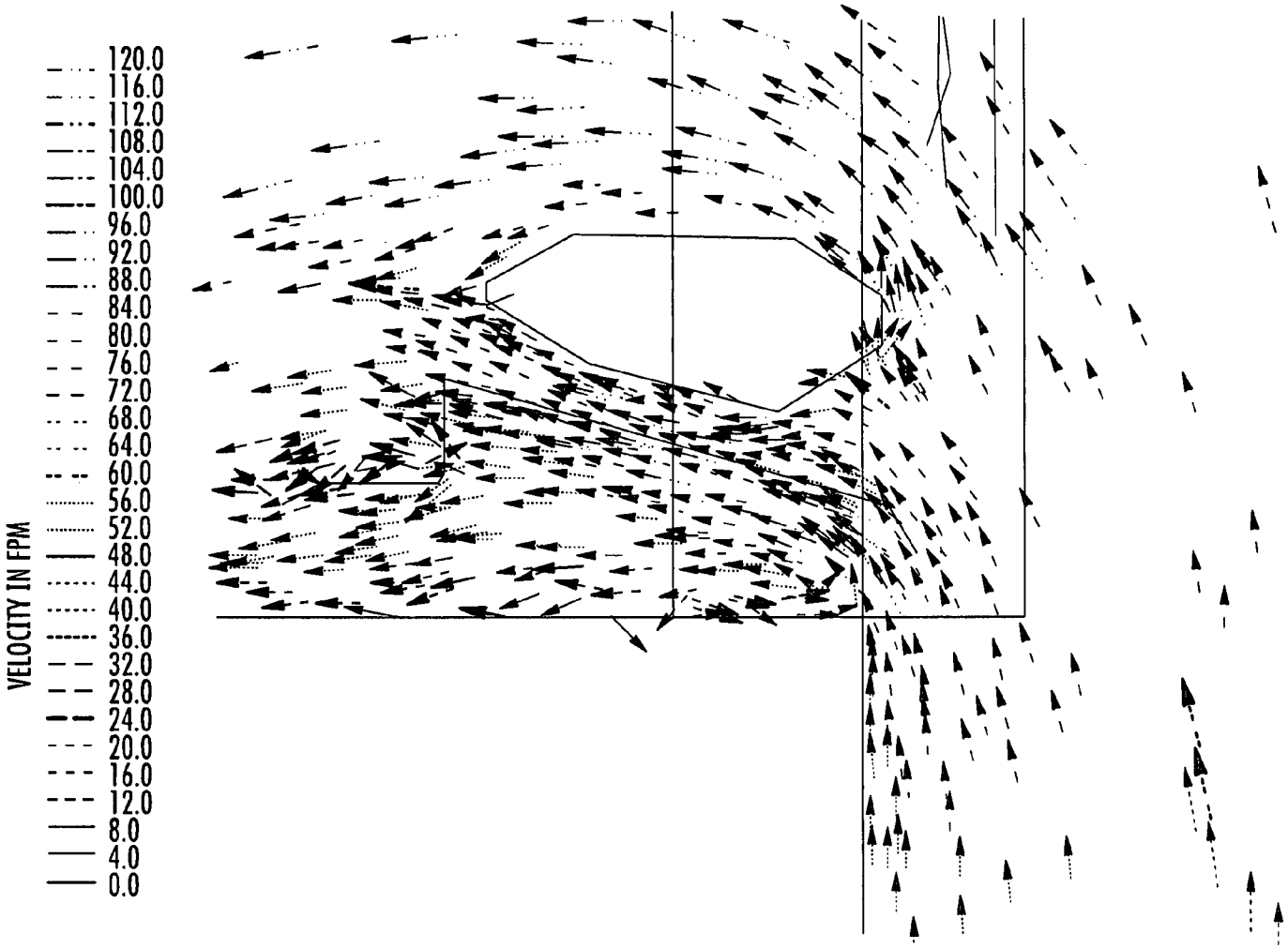
FIG. 12 is a CFD vector velocity analysis of a formed metal teardrop handle and dynamic bypass turning vane work surface airfoil.
Figure 13B:
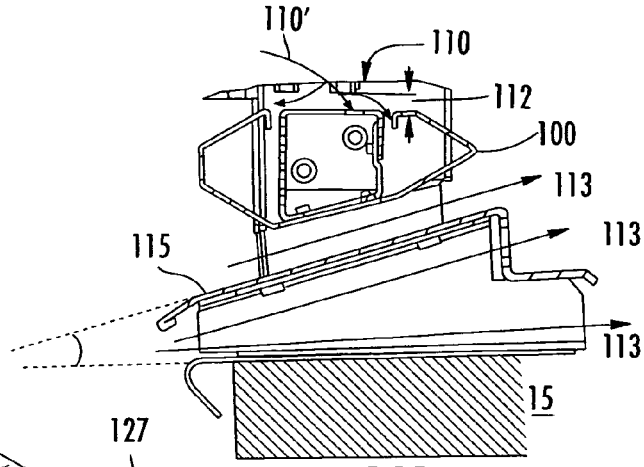
FIGS. 13A and 13B illustrate two views of an embodiment of the teardrop shaped handle and horizontal sash.
Figure 13A:
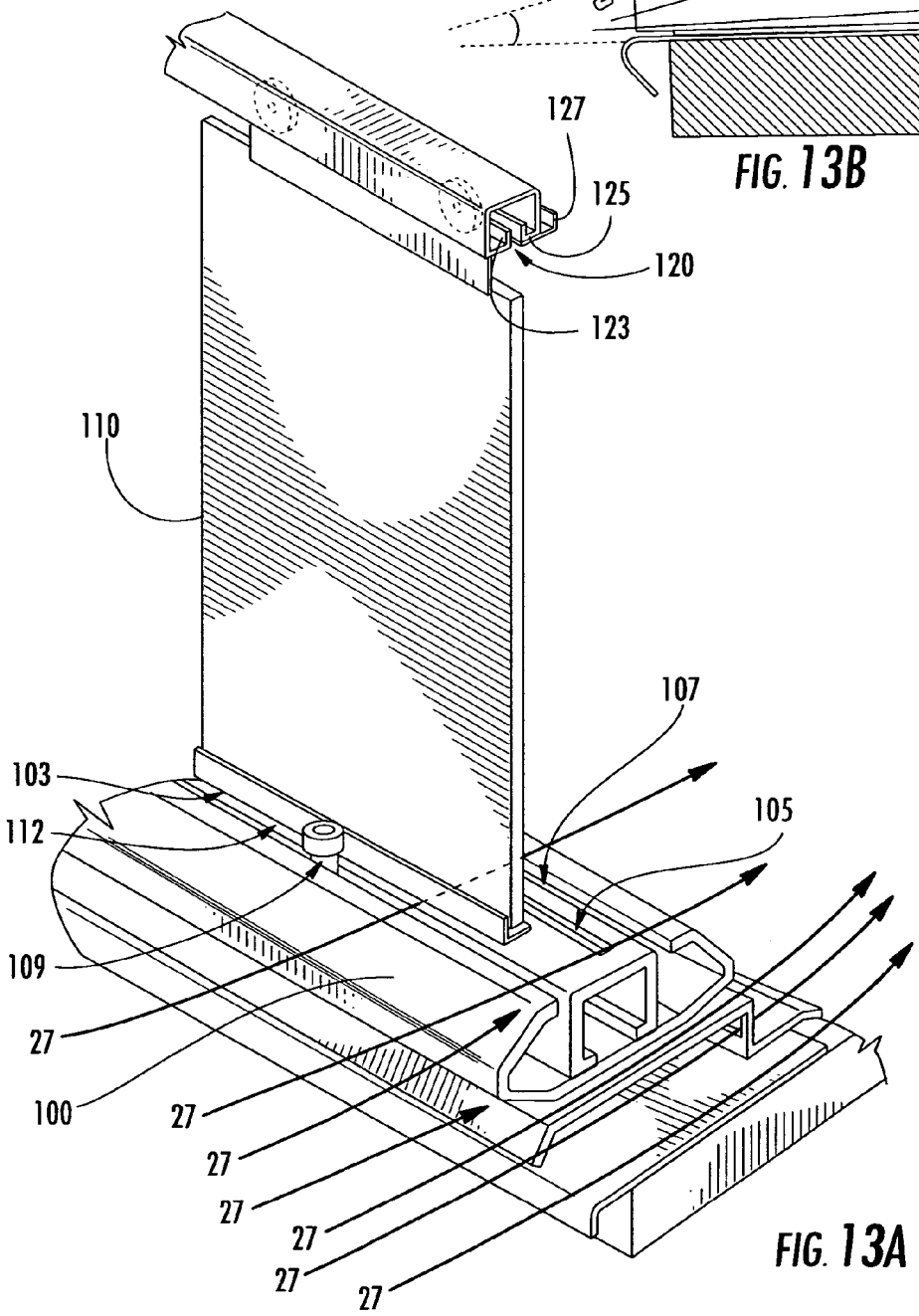

Referring to FIGS. 13A and 13B, a tear drop shaped handle 100 that minimizes or eliminates these problems by eliminating boundary layer reverse airflow eddies and localized vortexes from forming around the handle. The tear drop shaped sash handle 100 has no pinch points. The tear drop shaped sash handle 100 preferably has minimal surface obstructions. Even more preferably, the handle 100 is coated with low surface drag coefficient coatings such as Teflon brand synthetic resin. The exact dimensions of the tear drop shaped handle are not critically important and in an alternate embodiment the handle has rounded edges. Air circulating freely on all sash handle surfaces minimizes or eliminates chemical laden fumes from lingering at the sash handle. FIG. 12 is a computational fluid dynamics (CFD) vector velocity analysis of a formed metal tear drop handle and dynamic bypass turning vane work surface airfoil, and provides a cross-sectional view of the shape of the tear drop shaped sash handle 100.

CFD is an accurate and well-validated analytical method to assess designs before manufacturing and benchmark testing. CFD eliminates the empirical trial and error smoke and tracer gas testing methods used to design and adjust prior art fume hoods. Along with lighting and shading, important airflow parameters can be illustrated such as air velocity and direction, air temperature and humidity effects, air contamination effects, virtual reality tracer gas testing and all physical aspects of airflow.

The CFD vector velocity analysis illustrates the advantages of the tear drop shape handle. The CFD study illustrates that even a metal-formed teardrop handle without maximizing aerodynamic smoothness eliminates the formation of eddy airflow reverses and localized vortexes. The embodiment of the tear drop handle design incorporates three narrow surface slots as lower horizontal panel sash guides. These slots eliminate the surface turbulence caused by prior art horizontal slide channels.

Referring to FIG. 13A, which illustrates the design incorporated into a triple track horizontal or triple track combination vertical/horizontal sash hoods. In this embodiment, a horizontal sash panel 110 is positioned on a front track 103. There is also a center track 105 and a rear track 107 for additional panels not shown. One or two metal tabs 109 per sash panel 110 are inserted in one of the sash handle 100 triple track slots that guide the lower horizontal sash panel with upper roller support on an upper roller track 120. The upper roller track 120 has three corresponding tracks 123, 125 and 127 as those of the sash handle 100. The metal tabs 109 and sash handle slots offer a self cleaning mechanism versus prior art sash handle channels that collect debris and are prone to chemical attack. The tabs 109 can be easily lifted to remove sash panels 110 for cleaning and loading the fume hood with large equipment. The air gap created 112 between the tear drop handle and horizontal sash panels allows air to move smoothly across the handle eliminating the formation of internal localized eddies causing airflow reversals.

FIG. 13B illustrates a cross-section of the tear drop sash handle 100 and along with a combination work surface bypass diffuser and dynamic turning vane airfoil (BDTVA) 115. FIG. 13B also provides a view of the angle of the BDTVA as provided by the chart in FIG. 8, along with the corresponding number of slots 113 and an angle of 20°, which in this embodiment is 3. In the preferred embodiment the bottom surface of the handle 100 runs parallel to the top surface of the combination work surface bypass diffuser and dynamic turning vane airfoil (BDTVA) 115 thereby creating the top slot 113. In FIG. 13B, two horizontal sash panels 110 and 110' are shown.

High Performance Low Airflow Fume Hood Field Conversion Kit

The present invention provides for the conversion, preferably on site, of an existing hood to a high performance low airflow fume hood. The existing fume hood is modified with the new articulating auto-controlled baffle to form a Rear bypass conduit and a vortex chamber turning vane. Optionally, the conversion also includes a triple track horizontal, or combination vertical and triple track horizontal sash embodied with other described features, such as the teardrop shaped sash handle. In one embodiment, the required equipment to perform the conversion is provided in a field conversion kit. In the typical conversion, the existing prior art rear baffle assembly is removed, and sash window either removed and replaced with new combination vertical/horizontal sash or removed or raised and abandoned in place and replaced with a horizontal only sash. The placement of the vortex chamber turning vane and other equipment is dependent on the calculation of the ERe and in a configuration in accordance with FIG. 8.

Typical existing fume hood furniture construction tolerances are +/− one inch. Typical sash opening heights vary from 27" to 36". The internal chamber widths of existing fume hoods tend to vary up to 9" per nominal hood length and height from 47"to 60" inches. Preferably, the high performance low airflow fume hood conversion kit widths be adjustable to accommodate the different fume hood dimensions and tolerances. However, in an alternate embodiment, the conversion kit could be custom manufactured to field dimensions.

Figure 14:
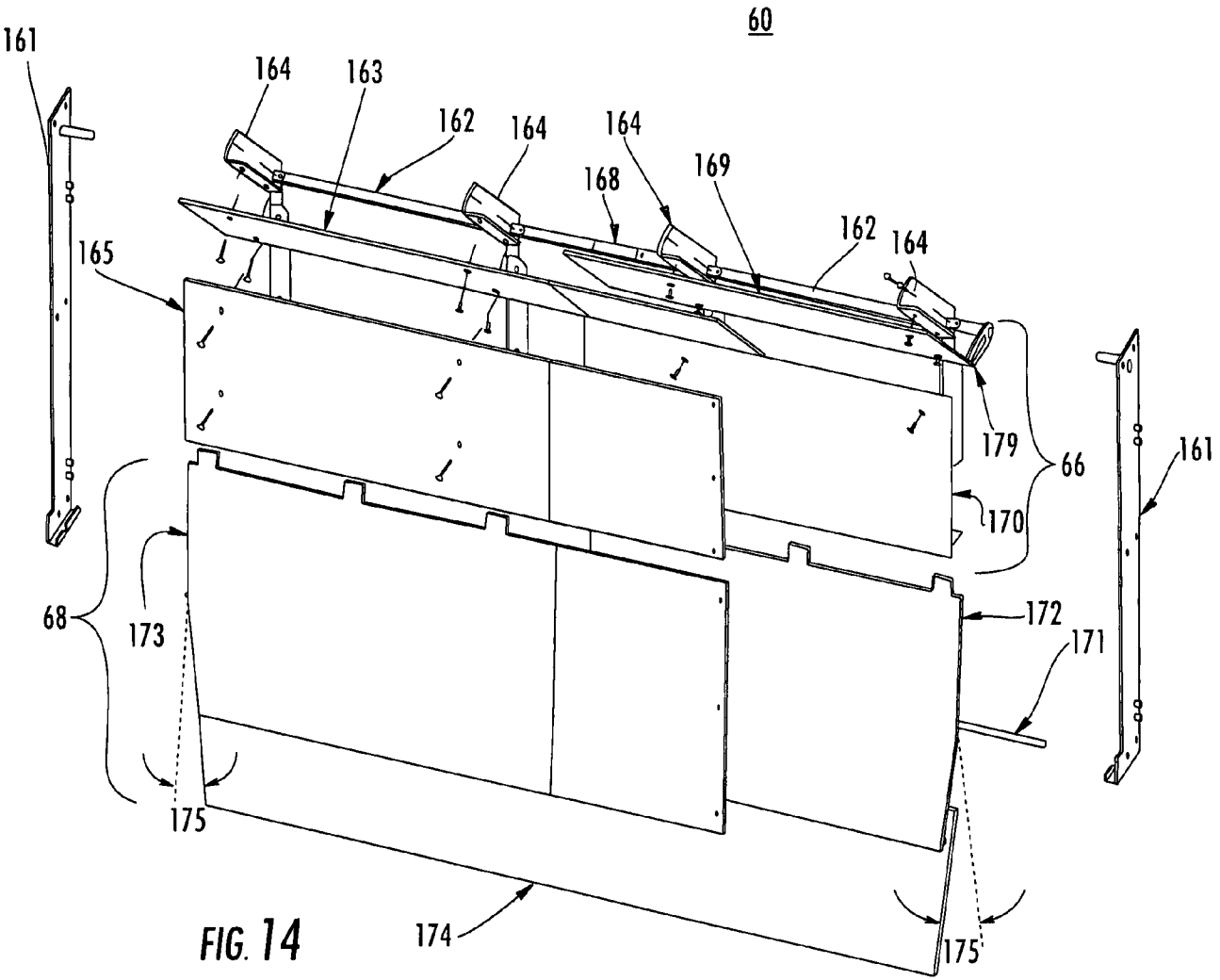
FIG. 14 illustrates an embodiment of rear baffle assembly kit.

Typically prior art fume hoods have internal widths that vary from the following nominal hood length:

4 foot hood=32"-41" internal width
5 foot hood=44"-53" internal width
6 foot hood=56"-65" internal width
8 foot hood=80"-89" internal width FIG. 14 illustrates an embodiment of a rear baffle assembly 60 kit. The baffle assembly 60 can be manufactured from any material or coatings that best support the anti-corrosion properties of the chemicals used in the fume hood. The baffle assembly 60 is supported from wall left part 161 and right part 161' brackets that are screw fastened to existing non asbestos lined fume hoods and preferably with chemical resistant epoxy adhesive for asbestos lined fume hoods. The top articulating baffle assembly 66 is comprised of a series of interconnected parts 163, 164, 165, 169 and 170 connected preferably by machine screws as shown. The assembly preferably has a lift out feature for ease of cleaning baffle conduit of trapped debris. The top baffle assembly 66 is supported on a telescoping square rod assembly 162 and 168, with an actuator drive clevis bracket 179, the lower articulating baffle 68 is assembled from parts 172 and 173. The lower articulating baffle assembly 68 is interconnected to top baffle with tabs (not shown) inserted into top baffle assembly 66 and supported by rod 171. The lower baffle assembly 68 increases lower baffle corner slot exhaust airflow by tapering angle 175 by calculating E Re FIG. 8 from about the midpoint of the lower baffle sides 172 and 173 to the bottom support. The increased lower baffle corner slot exhaust reduces the otherwise increased corner static pressure losses within the baffle conduit.

The baffle assembly accommodates a 47" internal height prior art hood. Optional extension 174 is added to the lower baffle for conversion of hoods with internal heights greater than about 47"; the gap between work surface and lower baffle exhaust slot opening is 3".

Figure 15B:
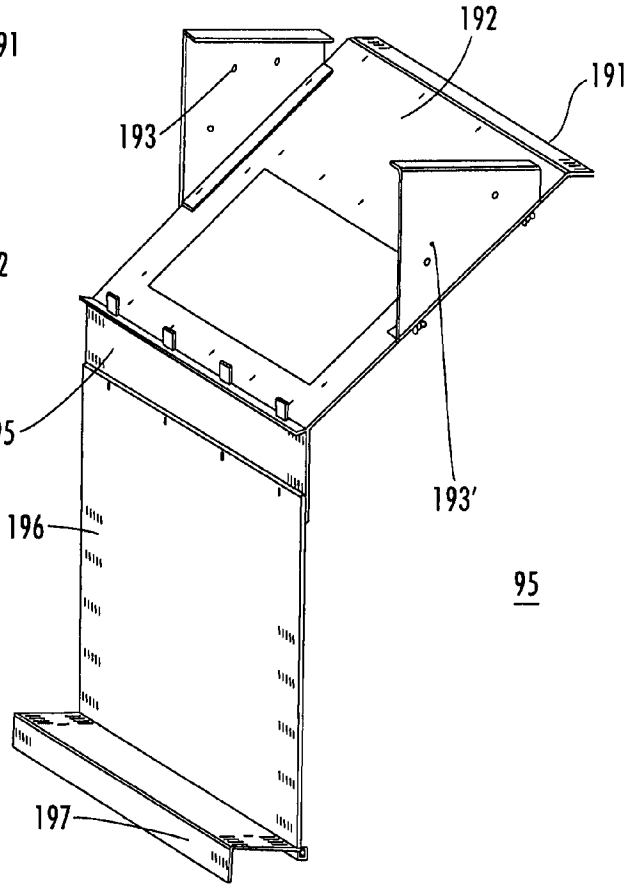
FIGS. 15A and 15B illustrate two views of one embodiment of a vortex chamber turning vane kit required for control sequence FIG. 9.
Figure 15A:
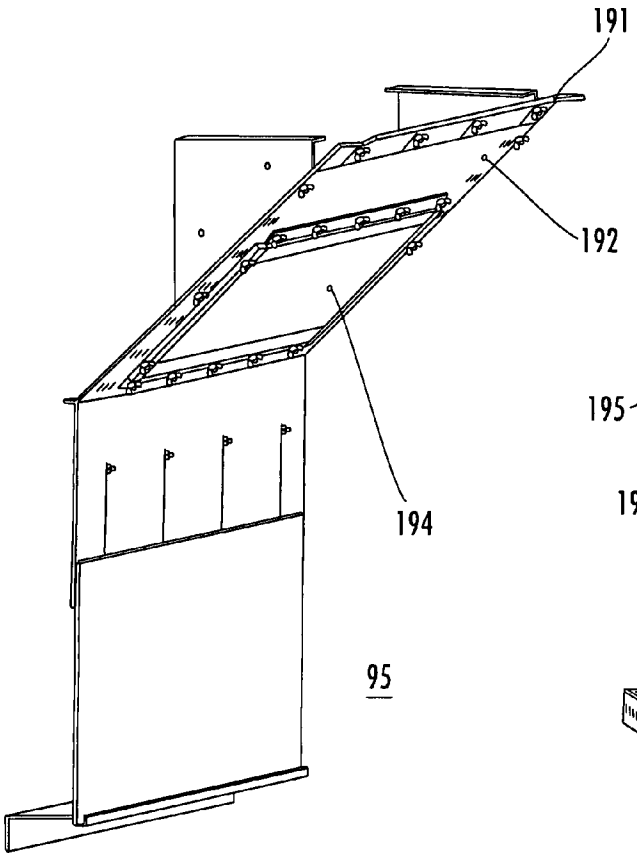

FIGS. 15A and 15B illustrate two views of one embodiment of a vortex chamber turning vane 95 kit required for control sequence FIG. 9. The vortex chamber turning vane 95 is comprised of an upper panel 192 connected to a top edge 191 that is preferably angled downward from the upper panel. The upper panel 192 is supported by a left bracket 193 and a right bracket 193' that fasten to existing asbestos liners preferably using chemical resistant epoxy and non asbestos liners with screws, with angle determined by calculating ERe FIG. 8. Top edge 191 is adjustable so that it can seal the vortex chamber turning vane 95 to existing fume hood ceilings. Incorporated within the upper panel 192 is a Plexiglas panel 194, which is removable for servicing hood lights. An adjustable, expandable lower panel 196 is connected to the upper panel 192 by way of an intermediate panel 195 that interlocks by tabs that also serves as an adjustable hinge to the upper panel 192 and the lower expandable sliding panels 195 and 196 and secured by mechanical screw connecting means. Panel 196 lower edge is supported by 197 and seals sash 18 (not shown). When installed in accordance with FIG. 9, the vortex chamber turning vane 95 closes the area between the sash 18 and the vortex chamber 16.

Figure 16B:
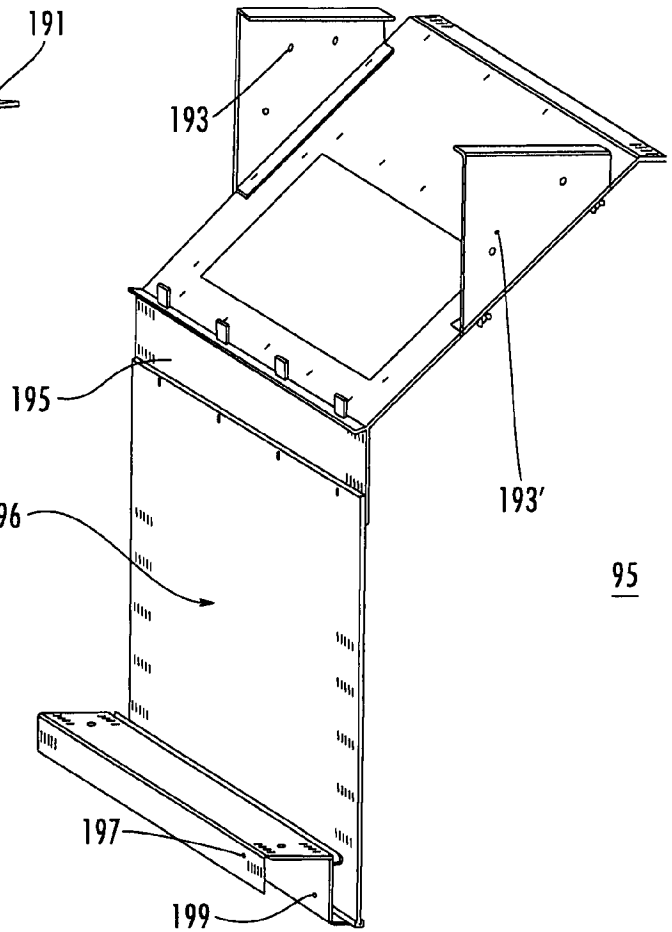
FIGS. 16A and 16B illustrate two views of one embodiment of a vortex chamber turning vane kit required for control sequence FIG. 10 and FIG. 11.
Figure 16A:
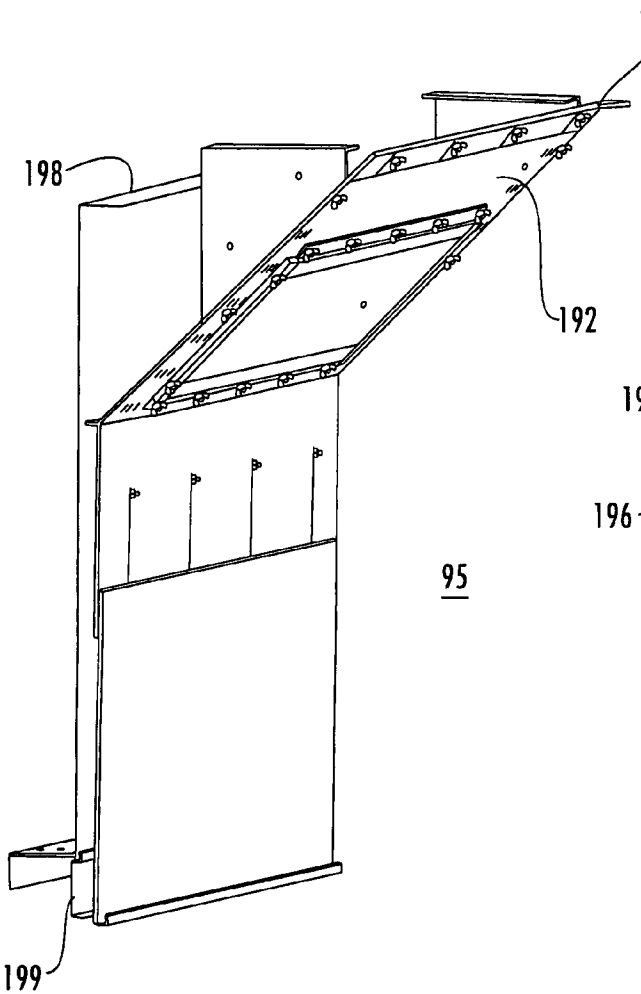

FIGS. 16A and 16B illustrate two views of an embodiment of a vortex chamber turning vane 95 kit required for control sequence FIG. 10 and FIG. 11. The kit is similar to that of the kit for control sequence 13 (FIG. 15A) with some changes. Top edge 191 of upper panel 192 is adjusted to achieve vortex bypass airflow (VBA) as calculated in step No. 10. Additional parts 198 and 199 are included to create the VBA bypass conduit, which allows air to circumvent the vortex chamber 16. Panel 198 is secured to the top front edge of enclosure 12 using chemical resistant epoxy for asbestos lined fume hoods and screws on non asbestos lined fume hoods and the lower edge is supported on 197. Part 199 supports lower edge of panel 196 which forms the bypass conduit with part 198. Control sequence FIG. 11 vortex chamber turning vane does not use brackets 193 and 193' as the upper panel 192 is hinged and cannot be fixed into place by these brackets, which position is preferably actuator controlled by a vortex total pressure controller (not shown).

Figure 17:
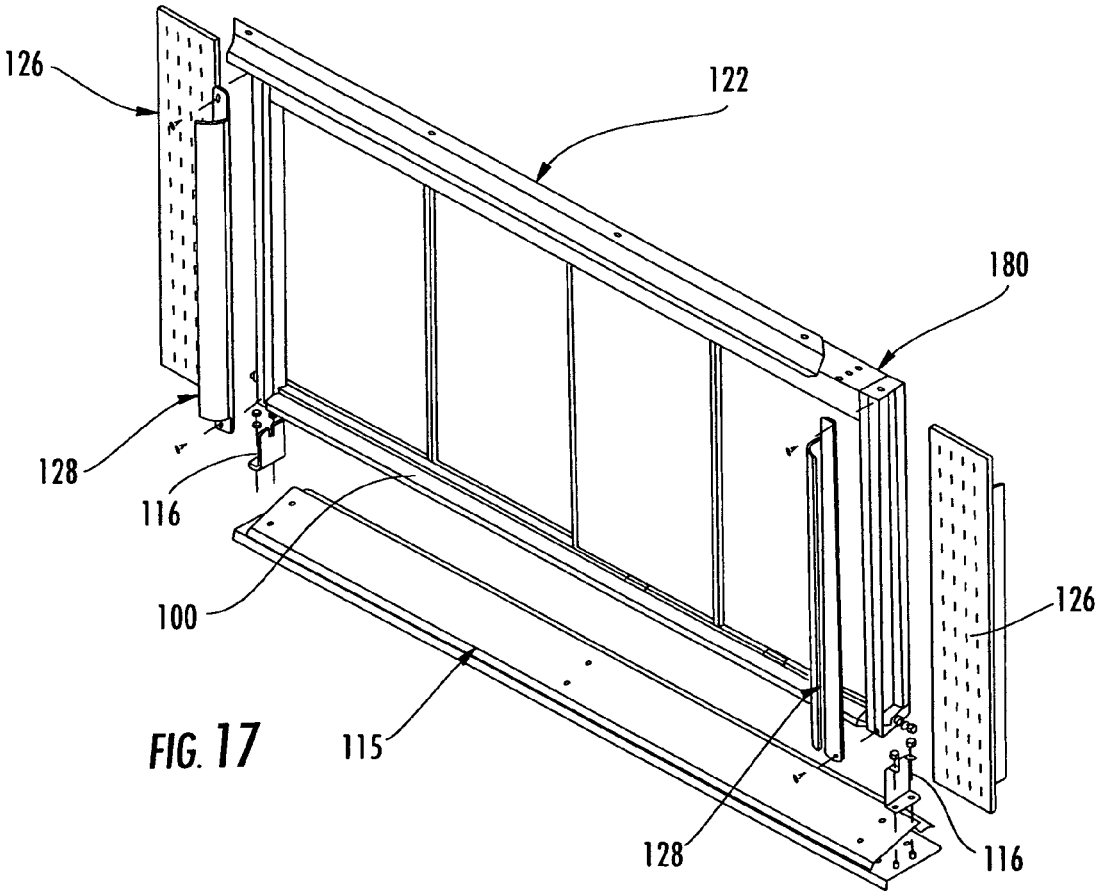
FIG. 17 illustrates one embodiment of a kit to field convert an existing prior art vertical or combination vertical horizontal sash into a triple track horizontal sash.

FIG. 17 illustrates one embodiment of a kit to field convert an existing prior art vertical or combination vertical horizontal sash into a triple track horizontal sash 180 with tear drop sash handle 100 and combination bypass diffuser and dynamic turning vane bypass airfoil (BDTVA) 115. The upper roller track 120 sash frame is shorter in width than the existing hood opening. Post spacer panels 126 fill gaps to eliminate existing sash channel turbulence. New post airfoils 128 are attached to the spacer panels 126. Airfoils 128 reject existing turbulence created by picture window and utility valve handles in many existing hoods. The existing combination vertical/horizontal hood sash being converted can either be removed and or modified or replaced, or lifted and abandon in place if converted to a horizontal sash. A deflector 122 is installed over triple track horizontal sash 180 to reject unwanted down flow air currents from supply make up air ceiling diffusers.

If the existing counter balance weight system is fully functional, then the existing fume hood vertical sash is replaced using conversion upper roller track 120 sash frame and horizontal triple track as described in FIG. 18. The existing counter weight system may be reused or a new counterweight system added as a part of new window frame system. Post airfoils 128 are attached to existing posts. Combination work surface bypass diffuser and dynamic turning vane (BDTVA) 115 replaces existing airfoil and is secured to the hood by brackets and screws 116. BDTVA airfoil 115 is located out of the fume chamber and beneath the sash handle instead of inside the hood. This location contributes to the stable vortex conversion hood being safer and energy efficient, and also prevents Bunsen burner flame outs and allows for sensitive powder measurements requiring a triple beam electronic scale.

Figure 18A:
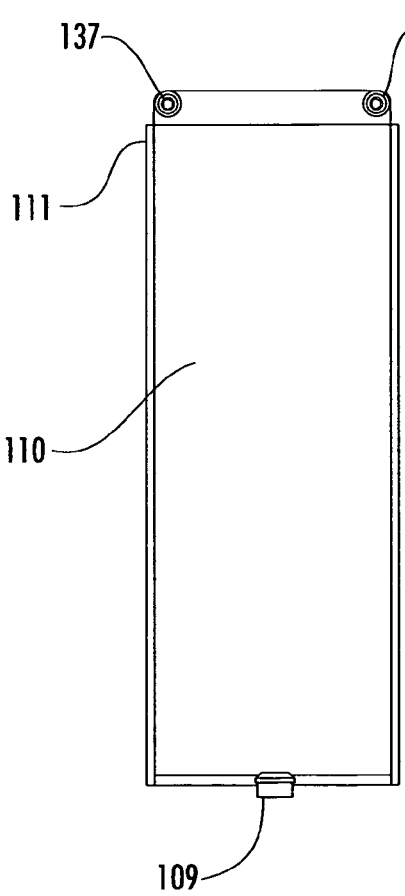
FIGS. 18A, 18B and 18C illustrate multiple views of a horizontal sash panel 110 for use with the triple track horizontal sash conversion or with newly constructed hoods.
Figure 18B:
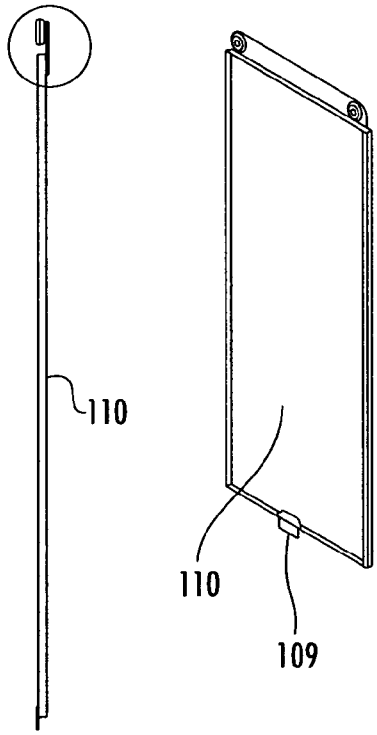
Figure 18C:
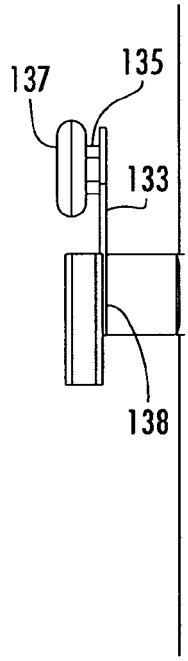

FIGS. 18A and 18C illustrate two views of a preferred horizontal sash panel 110 for use with the triple track horizontal sash conversion or with newly constructed hoods. The sash panel 110 is preferably constructed of polycarbonate unless the chemical use requires a different panel material. Sash panel edges are protected by edge guards 111. Top roller guides 137 are secured to the sash panel 110 by way of posts 135 connected to a sash extension 133 that is secured to the sash panel at about position 138, as illustrated in more detail in FIG. 18B. A single tab bottom guide 109 is generally used, except two tabs are required on radioactive hoods with leaded sash panels 110.

Exhaust Damper Assembly

Figure 19:
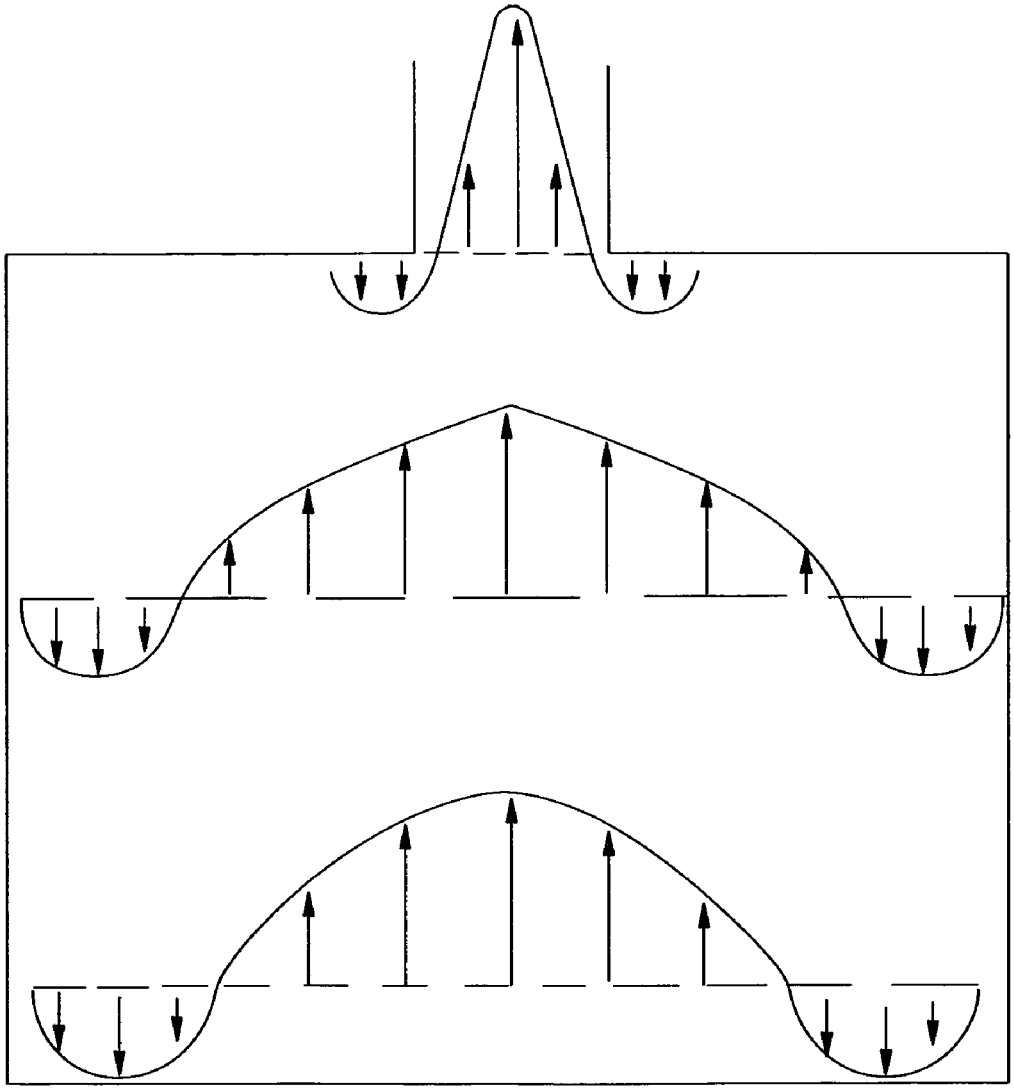
FIG. 19 (PRIOR ART)
FIG. 19 illustrates prior art fume hood velocity profile of the rear baffle plenum.

An apparatus and method of replacing existing exhaust duct airflow controls with a simple hard balance constant exhaust airflow communication system is also provided. Prior art fume hood exhaust connections are typically round with a sharp edge facing airflow. The baffle conduit varies from 2½" to 3" deep by the internal width and height of the prior art fume hood. The aspect ratio of a conduit or plenum is the relationship of the depth versus the width. One aspect of the invention is based on the discovery that this relationship should not be less than 0.25. On prior art fume hoods, however, the baffle aspect ratio is typically 0.0625 or less. This ratio creates high exhaust airflow in the center baffle exhaust slots with low or no exhaust slot airflow on the left and right sides and the lower corners of the hood. FIG. 19 illustrates prior art fume hood uneven velocity profile of the rear baffle conduit, where the arrows represent airflow.

Figure 20:
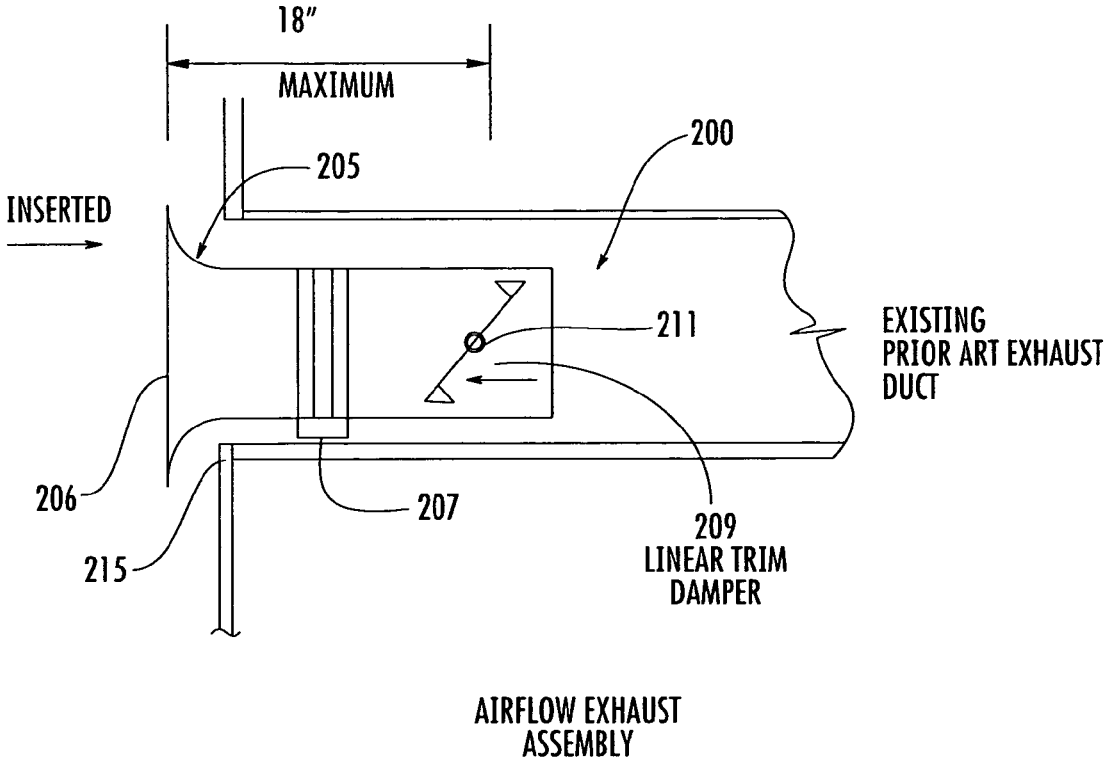
FIG. 20 illustrates a side view of a bellmouth exhaust damper assembly inserted into an existing prior art exhaust plenum.

To maximize the performance of prior art fume hood conversion into a high performance low airflow fume hood preferably includes a bellmouth inlet assembly 200 as illustrated in FIG. 20. The assembly 200 includes a bellmouth exhaust nozzle 205 and preferably an airflow meter 207 to measure required FHE and a linear trim damper 209 that equalizes the airflow velocity and static pressure across the baffle conduit and is adjusted for required FHE. The distance between the axis 211 of the linear trim damper 209 and the leading edge 206 of the bellmouth exhaust nozzle 205 is preferably not more than 18 inches. The linear exhaust damper axis 211 is positioned to point out towards the fume hood face. The assembly 200 is inserted into the existing exhaust discharge connection 215 from the inside of the hood.

Figure 21:
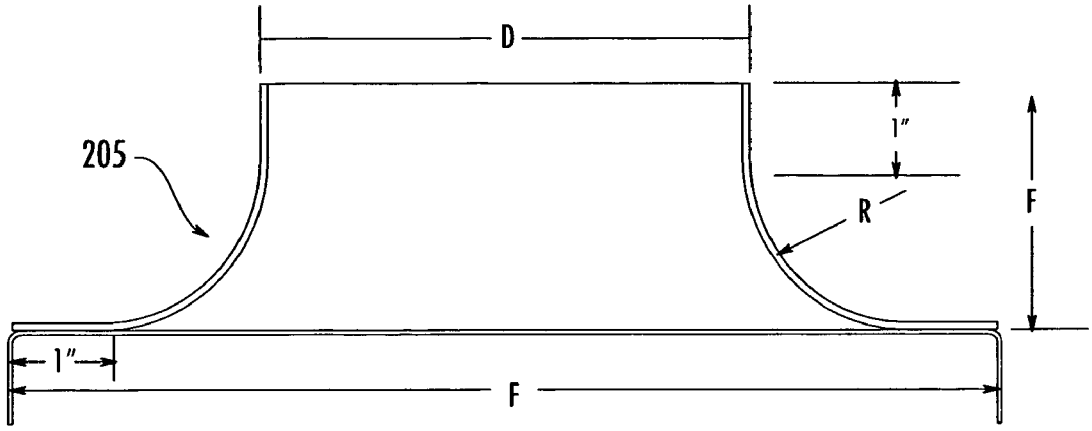
FIG. 21 illustrates a cross section of a bellmouth exhaust nozzle.

FIG. 21 illustrates a cross section of the bellmouth exhaust nozzle neck connection 205. The diameter D is sized to achieve FHE cfm (step no.4) at 1200 to 1300 FPM duct velocity. The diameter D in square feet area can be easily solved by dividing FHE by 1250 FPM and selecting the closest size bellmouth in accordance with Table 2 that equals the calculated value in square feet in accordance with the following table. FHE/1250 FPM=Area of bellmouth in Sq. feet

TABLE 2

| "D" (Area Sq. Ft) | "E" | "F" | "G" |
|---|---|---|---|
| 4 (0.087) | 9" | 1½" | 1½ |
| 5 (0.136) | 10" | 2½ | 1½ |
| 6 (0.197) | 12" | 3" | 2" |
| 7 (0.267) | 13" | 3" | 2" |
| 8 (0.349) | 14" | 3" | 2" |
| 9 (0.442) | 15" | 3" | 2" |
| 10 (0.545) | 16" | 3" | 2" |
| 11 (0.660) | 19" | 4" | 3" |
| 12 (0.785) | 20" | 4" | 3" |

Figure 22:
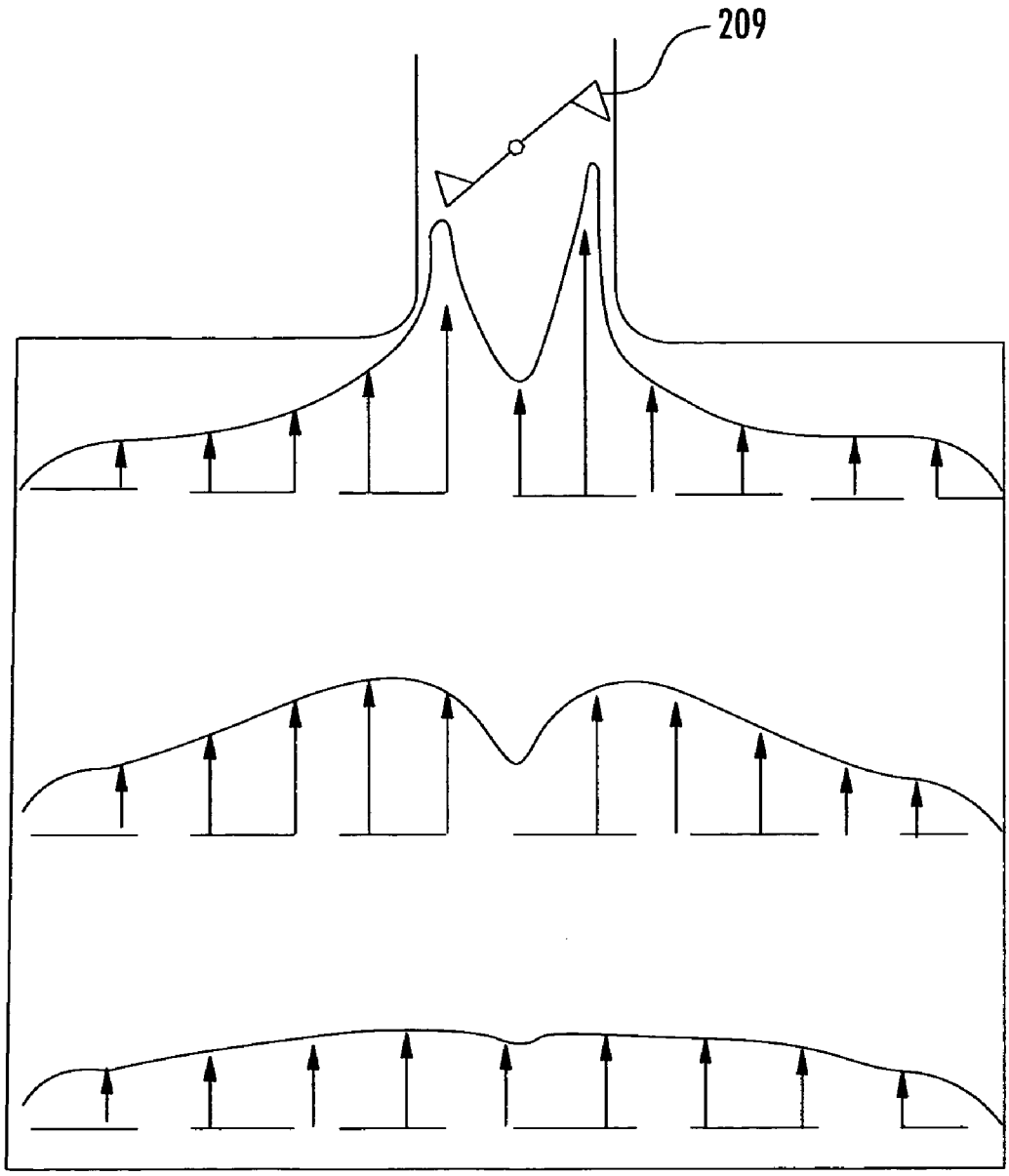
FIG. 22 illustrates a stable vortex conversion rear baffle velocity profile.

The linear trim damper 209 style, size and location creates the conditions to produce the velocity airflow pattern that overcomes up stream duct configuration patterns and aspect ratio induced static pressure losses and low airflow velocity on the left and right sides, and lower corners, of the exhaust baffle conduit. FIG. 22 illustrates the now induced uniform velocity profile across the bypass conduit by the incorporation of bellmouth inlet assembly 200 (not shown) and linear trim damper 209. The assembly 200 induces air flow velocity to equalize across the baffle conduit to create a more uniform baffle exhaust slot air velocity across and thru the baffle conduit. The linear trim damper 209 will be at a 60% to 70% opening at design FHE airflow when damper is sized at 1200 to 1300 FPM duct airflow velocity that will induce these desired effects at the following flow coefficient (Cv) at 65% opening.

TABLE 3

| Valve Size | Flow Coefficient Cv at 65% Open | FHE (step 4) Exhaust CFM |
|---|---|---|
| 6"0 | 630 | 200-250 |
| 8"0 | 1115 | 251-475 |
| 10"0 | 1790 | 476-725 |
| 12"0 | 2515 | 726-1000 |

Figure 23A:
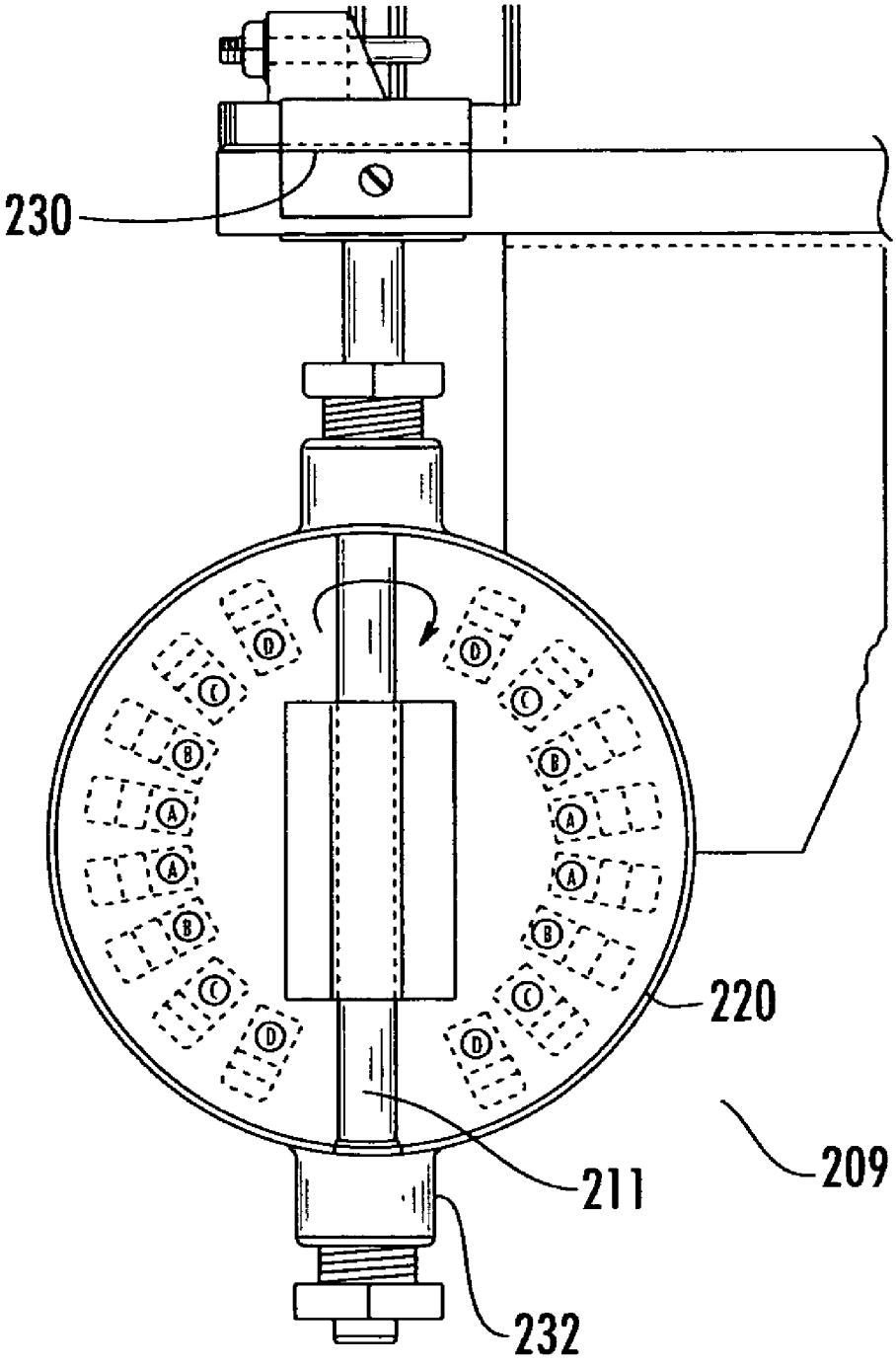
FIGS. 23A and 23B illustrate two views of one embodiment of a damper design.
Figure 23B:
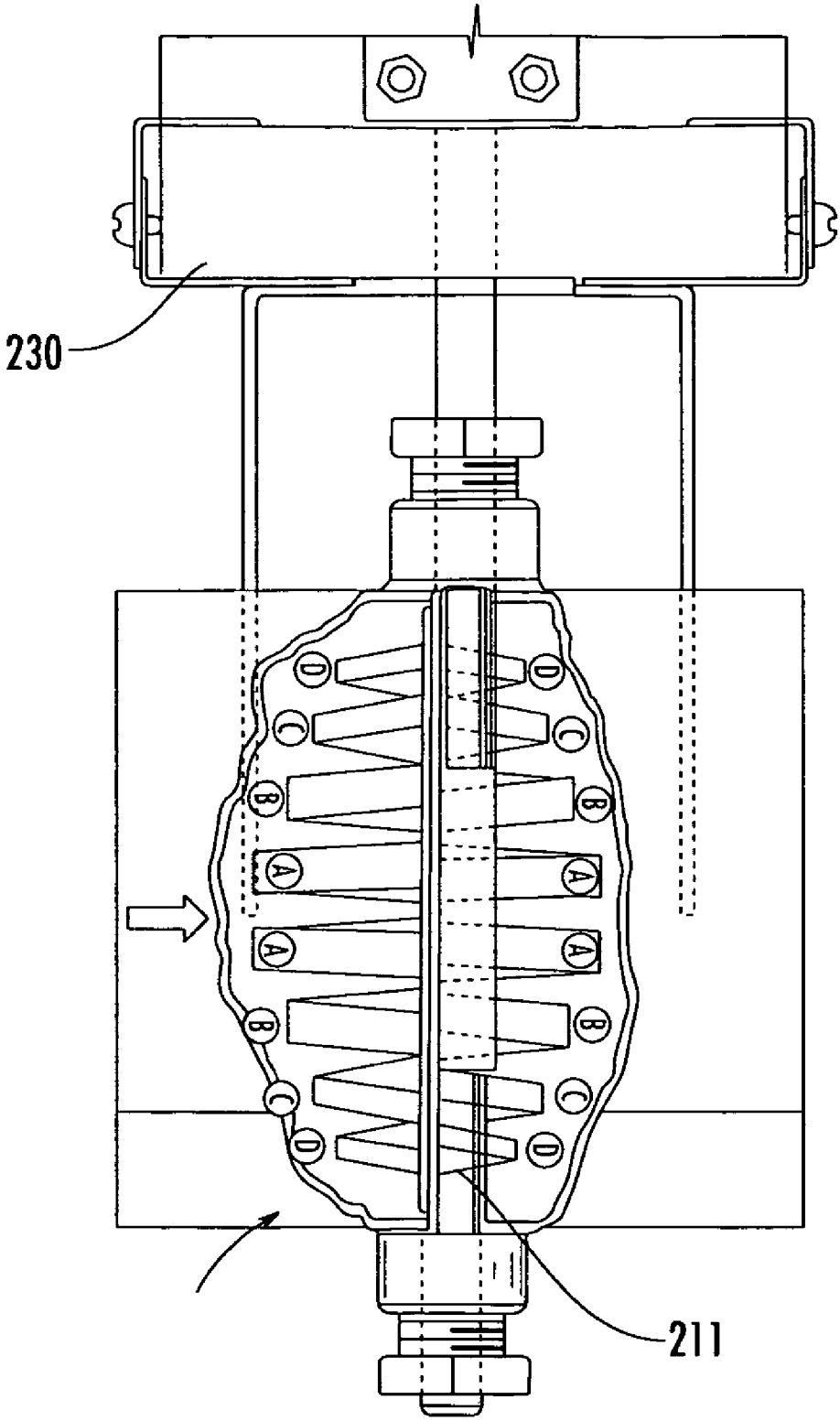

Standard ventilation flat sheet metal style butterfly duct dampers have quick opening trim, not linear trim. To achieve linear airflow characteristics, teeth A-D are preferably proportionally sized according to FIGS. 23D and 23E and are preferably positioned according to FIG. 23C on the leading edges FIGS. 23A and 23B of the rotating disc 220. The teeth protrude into the air stream FIG. 23B, creating linear airflow characteristics to damper opening that also reduce static pressure losses and noise. The teeth can be substituted with a proportionally sized ½" perforated plate which still produces a linear airflow but with an increase in static pressure losses and noise. FIG. 23A illustrates the front view and FIG. 23B the side view of the preferred damper design, which shows an actuator 230. The damper 209 can have either a metal seat as shown or bubble tight rubber seal. There are no size limitations to the design except the teeth become proportionally bigger as the damper size changes. A swing-through round disc with 90 degree rotational design is required for dampers smaller than 6" in diameter. Larger dampers will be trunnion style with elliptical shape disc with 60 degrees of rotation.

Unlike prior art fume hoods based on face velocity, fume hood conversion to a high performance low airflow hood is based on a precise airflow control achieved by calculating FHE using ERe as described above. Using prior arts method of multiple face velocity measurement of the sash opening to determine fume hood exhaust airflow is imprecise. For one reason, the person taking the measurements can greatly influence the results. For accurate fume hood FHE measurement, an airflow meter and airflow pitot meter probe is used. It is located between the leading edge 206 of the bellmouth exhaust nozzle 205 and linear trim damper 209 and transverses the airflow velocity profile. In one embodiment, the flow pitot meter probe having an upstream tube and a downstream tube that transverse the airflow assembly as disclosed in U.S. Pat. No. 4,959,990 is used in the preferred embodiment. The pressure transducer for flow measurement is located in the bore of a housing connecting the total pressure and static pressure tubes and by incorporating the differential pressure transducer into a valve that can block flow between the tubes airflow meter can be used for either remote or local airflow communication monitoring system. The differential pressure transducer and flow pitot meter can also be calibrated both locally and remotely. The airflow pitot probe can be used with the pressure transducer for other sequences.

Figure 24A:
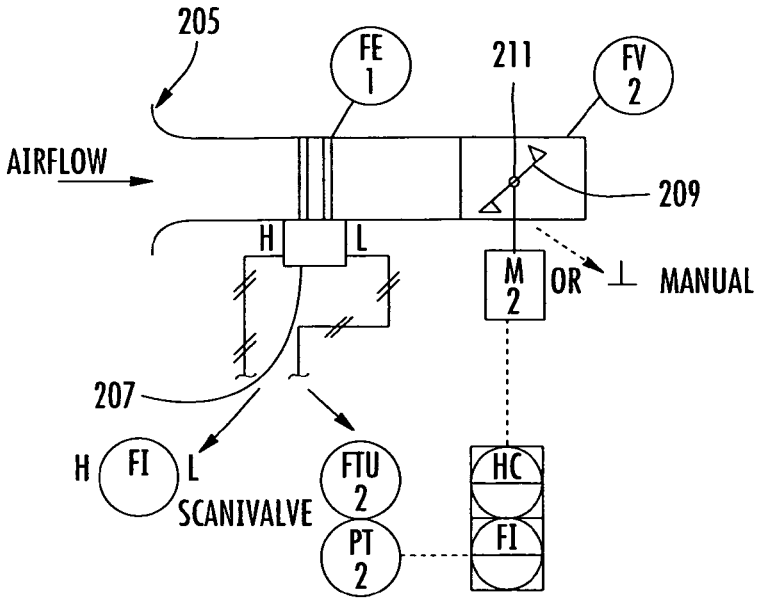
FIGS. 24A and 24B illustrate two alternate communication system sequences for commissioning and balancing FHE system.

Sequence FIG. 24A illustrates a commissioning and balancing FHE communication system which can be accomplished either locally or remotely. The damper 209 can be adjusted manually by reading desired airflow from pitot meter flow element FE-1 on airflow indicator FI-1 and manually adjusting linear fume hood exhaust damper FV-2 or remotely by automatically scanning pitot meter flow element FE-1 pitot signal through commercially available multiple pressure selecting Scanivalve system thru differential pressure transducer PT-2 and sequencing computer FI-2 and HC-2 controlling actuator M-2 on linear damper FV-2 to obtain desired airflow.

Figure 24B:
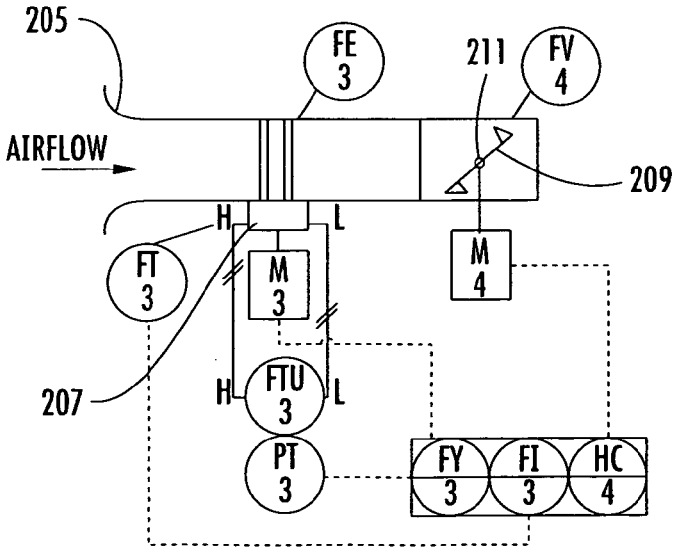

FIG. 24B illustrates an automatic communication sequencing balancing and commissioning FHE system utilizing the combined differential pressure transducer/pitot tube airflow meter FE-3/FT-3 with remote auto zero and span calibration thru computer FY-3 and Scanivalve system FTV with differential pressure transducer PT-3 and probe actuator M-3. Computer function HC-4 automatically adjusts for required FHE airflow by manipulating linear damper FV-4 thru actuator M-4 through computer HC-4.

What is claimed is:

1. A stable vortex fume hood converted from an existing fume hood having a front face with an access opening into a working chamber and a vortex chamber above the working chamber comprising:

i) an exhaust system connected to the fume hood including a fan and an exhaust duct;

ii) a rear baffle conduit connected to the exhaust system;

iii) a vortex bypass conduit adjacent the front face of said fume hood and connected to the exhaust system; and iv) a means for dynamically controlling the amount of air flowing through the vortex chamber by variably bypassing air though one or both of the rear baffle conduit and vortex bypass conduit, wherein the vortex bypass conduit is formed with a vortex chamber turning vane that is adjustable and positioned at an angle in accordance with an Effective Reynolds number to sustain a stable vortex in the vortex chamber.

2. The fume hood of claim 1 further wherein the rear baffle conduit is formed from a rear baffle assembly having an upper and lower interlocking or hinged, actuable baffles, wherein the lower baffle corner exhaust is angled in accordance with the Effective Reynolds number.

3. The fume hood of claim 1 further comprising a combination work surface bypass diffuser and dynamic turning vane airfoil.

4. The fume hood of claim 3 wherein the combination work surface bypass diffuser and dynamic turning vane airfoil is positioned out of the fume chamber and beneath the sash handle.

5. The fume hood of claim 4 wherein the combination work surface bypass diffuser and dynamic turning vane airfoil contains a number of slots and angle of the slots in accordance with the Effective Reynolds number.

6. The fume hood of claim 1 wherein the vortex chamber turning vane is hinged and the fume hood further comprises a turning vane actuator controlling the movement of the hinged vortex chamber turning vane.

7. The fume hood of claim 6 further comprising one or more sash opening position transducers that monitor the height and/or width of the sash opening, where the position transducers are in communication with the actuable baffle actuator, and wherein the actuator modulates the baffle dampers in response to signals from the position transducer, thereby varying the amount of air passing through the baffle slots thru the baffle conduit to the exhaust system.

8. The fume hood of claim 7 further comprising a vortex total pressure controller in communication with the one or more sash opening position transducers, wherein the vortex total pressure controller compares the sash opening to the vortex total pressure transducer input signal and wherein the actuator modulates the vortex chamber turning vane in response, thereby varying the amount of air passing through the vortex bypass conduit to the exhaust system.

9. The fume hood of claim 1 further comprising a dual non-pinch point tear drop shape sash handle including self-cleaning horizontal sash panel guide slots.

10. The fume hood of claim 2 further comprising a transducer that continuously measures the vortex total pressure difference between the vortex chamber and the exterior of the hood; a controller responsive to signals received from the transducer to proportionally vary the position of the upper and lower interlocking or hinged, actuable baffles.

11. The fume hood of claim 8 wherein the vortex total pressure controller continuously measures the vortex total pressure difference between the vortex chamber and the exterior of the hood.

12. The fume hood of claim 11 wherein the rear baffle conduit is formed from a rear baffle assembly with a kit having an upper and lower interlocking or hinged, actuable baffles.

13. The fume hood of claim 12 further comprising a controller responsive to signals received from the transducer to proportionally vary the position of the upper and lower interlocking or hinged, actable baffles.

14. The fume hood of claim 1 further comprising a multiple track horizontal sash.

15. The fume hood of claim 1 further comprising a bell mouth exhaust nozzle neck.

16. The fume hood of claim 15 further comprising an airflow meter to measure required FHE and a linear trim damper that equalizes the airflow velocity and static pressure across the rear baffle conduit.

17. The fume hood of claim 15 wherein the linear trim damper have that teeth protrude into the air stream.

18. A fume hood sash comprising a dual non-pinch point teardrop shape sash handle including self-cleaning horizontal sash panel guide slots.

19. The fume hood sash of claim 18 wherein the handle is coating with a low surface drag coating.

20. The fume hood of claim 1 further comprising a multiple track horizontal sash, wherein the sash is a combination, horizontal and vertical sash and further comprises a dual non-pinch point tear drop shape sash handle including self cleaning horizontal sash panel guide slots.

21. The fume hood of claim 1 further comprising:

i) a bell mouth exhaust nozzle neck; and ii) a linear trim damper positioned within the bell mouth exhaust nozzle neck to alter the exit velocity profile, wherein the linear trim damper has teeth that protrude into the exhaust airstream.

22. The fume hood of claim 15 further comprising an airflow meter measuring velocity and static pressure in a communication system with a linear trim damper.

23. The fume hood of claim 22 where the fume hood comprises a rear baffle conduit and the linear trim damper equalizes the airflow velocity and static pressure across the rear baffle conduit.

24. The fume hood of claim 13 wherein the transducer comprises an electronic balancing bridge including a sensor for detecting variations in the pressure difference between the vortex chamber and the exterior of the hood, said sensor being disposed adjacent to a port though a wall of said vortex chamber, said port being located in a portion of the path of said vortex; and operational amplifiers for amplifying signals from said sensor.

25. The fume hood of claim 13 wherein the amplitude of the signals from the transducer is proportional to the stability of the vortex, and the controller is a feedback control system which controllably varies the amount of air flowing and air flow pattern though the vortex chamber to maximize vortex stability.

26. The fume hood of claim 25 wherein the control system uses programmed proportional integral and adaptive gain algorithms in processing said signals.

27. The fume hood of claim 13 wherein the controller is an analog or digital real time computer.

28. The fume hood of claim 27 further comprising an airflow meter to measure required FHE, wherein the linear trim damper is adjustable for meeting the required FHE.

29. A method of converting an existing fume hood into a high performance low airflow, stable vortex fume hood comprising:

i) calculating the Effective Reynolds Number of the fume hood;

ii) calculating the Vortex Chamber Bypass Airflow required to maintain the Effective Reynolds Number; and iii) installing a vortex chamber turning vane within a vortex bypass conduit within the hood in accordance with the Vortex Chamber Bypass Airflow requirement and at an angle in accordance with the Effective Reynolds number, said vortex bypass conduit being positioned adjacent a front face of said hood, said front face including an access opening into a working chamber.

30. The method of converting an existing fume hood into a high performance low airflow, stable vortex fume hood of claim 29 further comprising creating rear baffle conduit formed from a rear baffle assembly having an upper and lower interlocking or hinged, actuable baffles, wherein the lower baffle corner exhaust is angled in accordance with the Effective Reynolds number.

31. The method of converting an existing fume hood into a high performance low airflow, stable vortex fume hood of claim 30 further comprising manipulating the lower baffle corner exhaust angle in accordance with the Effective Reynolds number.

32. The method of converting an existing fume hood into a high performance low airflow, stable vortex fume hood of claim 31 further comprising installing a combination work surface bypass diffuser and dynamic turning vane airfoil.

33. The method of converting an existing fume hood into a high performance low airflow, stable vortex fume hood of claim 32 wherein the combination bypass diffuser and dynamic turning van contains a number or slots and at an angle in accordance with the Effective Reynolds number.

34. The method of converting an existing fume hood into a high performance low airflow, stable vortex fume hood of claim 33 further comprising installing a bell mouth exhaust nozzle neck connection to the existing fume hood exhaust connections.

35. The method of converting an existing fume hood into a high performance low airflow, stable vortex fume hood of claim 29 further comprising installing a transducer that continuously measures the vortex total pressure difference between the vortex chamber and the exterior of the hood; a controller responsive to signals received from the transducer to proportionally vary the position of the upper and lower interlocking or hinged, actuable baffles.

* * * * *